US011188020B2

(12) United States Patent
Ogura et al.

(10) Patent No.: US 11,188,020 B2
(45) Date of Patent: Nov. 30, 2021

(54) METHOD OF PRODUCING BLADE, BLADE, IMAGE FORMING APPARATUS, AND IMAGE FORMING METHOD

(71) Applicant: Konica Minolta, Inc., Tokyo (JP)

(72) Inventors: Kunihiro Ogura, Hino (JP); Yukio Hosoya, Tama (JP); Taiki Amemiya, Hachioji (JP); Teruo Sasaki, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/224,102

(22) Filed: Apr. 6, 2021

(65) Prior Publication Data

US 2021/0325816 A1 Oct. 21, 2021

(30) Foreign Application Priority Data

Apr. 21, 2020 (JP) ..... JP2020-075497

(51) Int. Cl.
*G03G 21/00* (2006.01)
*G03G 15/02* (2006.01)

(52) U.S. Cl.
CPC ..... *G03G 21/0029* (2013.01); *G03G 15/0258* (2013.01); *G03G 21/0011* (2013.01)

(58) Field of Classification Search
CPC ..... G03G 21/0011; G03G 21/0017
USPC ..... 399/350
See application file for complete search history.

(56) References Cited

U.S. PATENT DOCUMENTS 6,704,539 B2 * 3/2004 Nakayama ..... G03G 21/0011 399/350
7,769,337 B2 * 8/2010 Itoh et al. ..... G03G 21/0017 399/350
8,965,264 B2 * 2/2015 Nakane et al. .... G03G 21/0017 399/350
9,798,284 B2 * 10/2017 Shimizu et al. ... G03G 21/0017

FOREIGN PATENT DOCUMENTS

JP 2016-167042 A 9/2016

* cited by examiner

*Primary Examiner* — William J Royer
(74) *Attorney, Agent, or Firm* — Lucas & Mercanti, LLP

(57) ABSTRACT

There is provided a method of producing a blade for cleaning a toner image retainer, the method including: binding an abutting layer that abuts against the toner image retainer and a supporting layer that supports the abutting layer, wherein the maximum value D of a difference between a first loss tangent at 1 Hz and a second loss tangent at 100 Hz of the blade that includes the abutting layer and the supporting layer satisfies the formula: $0.2 \leq D \leq 0.7$, wherein the maximum value D is a maximum value of a difference between the first loss tangent and the second loss tangent at temperatures within a range of 0° C. to 50° C.

16 Claims, 5 Drawing Sheets

METHOD OF PRODUCING BLADE, BLADE, IMAGE FORMING APPARATUS, AND IMAGE FORMING METHOD

The entire disclosure of Japanese patent Application No. 2020-075497, filed on Apr. 21, 2020, is incorporated herein by reference in its entirety.

BACKGROUND

Technological Field

The present invention relates to a method of producing a blade, a blade, an image forming apparatus, and an image forming method.

Description of the Related Art

In an electrophotographic type image forming apparatus, a toner image formed on a photoreceptor is transferred to an intermediate transfer body. The image forming apparatus has a cleaner, which cleans off the residual toner that has not been transferred and remains on the photoreceptor. The cleaner includes, for example, a blade that abuts against the surface of the photoreceptor (e.g., see JP 2016-167042 A).

It is desired that such a blade can maintain a prescribed cleaning function even under varying operating conditions including temperature, humidity, and frequency. That is, it is desired that deterioration in cleaning characteristics of a blade depending on operating conditions is minimized.

SUMMARY

The present invention has been made in consideration of the problems described above. Thus, an object of the present invention is to provide a method of producing a blade, a blade, an image forming apparatus, and an image forming method which can minimize the deterioration in cleaning characteristics depending on operating conditions.

To achieve the abovementioned object, according to an aspect of the present invention, there is provided a method of producing a blade for cleaning a toner image retainer, and the method reflecting one aspect of the present invention comprises: binding an abutting layer that abuts against the toner image retainer and a supporting layer that supports the abutting layer, wherein the maximum value D of a difference between a first loss tangent (Tan δ) at 1 Hz and a second loss tangent at 100 Hz of the blade that includes the abutting layer and the supporting layer satisfies formula (1):

[Mathematical Formula 1]

$$0.2 \leq D \leq 0.7 \quad (1)$$

wherein the maximum value D is a maximum value of a difference between the first loss tangent and the second loss tangent at temperatures within a range of 0° C. to 50° C.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
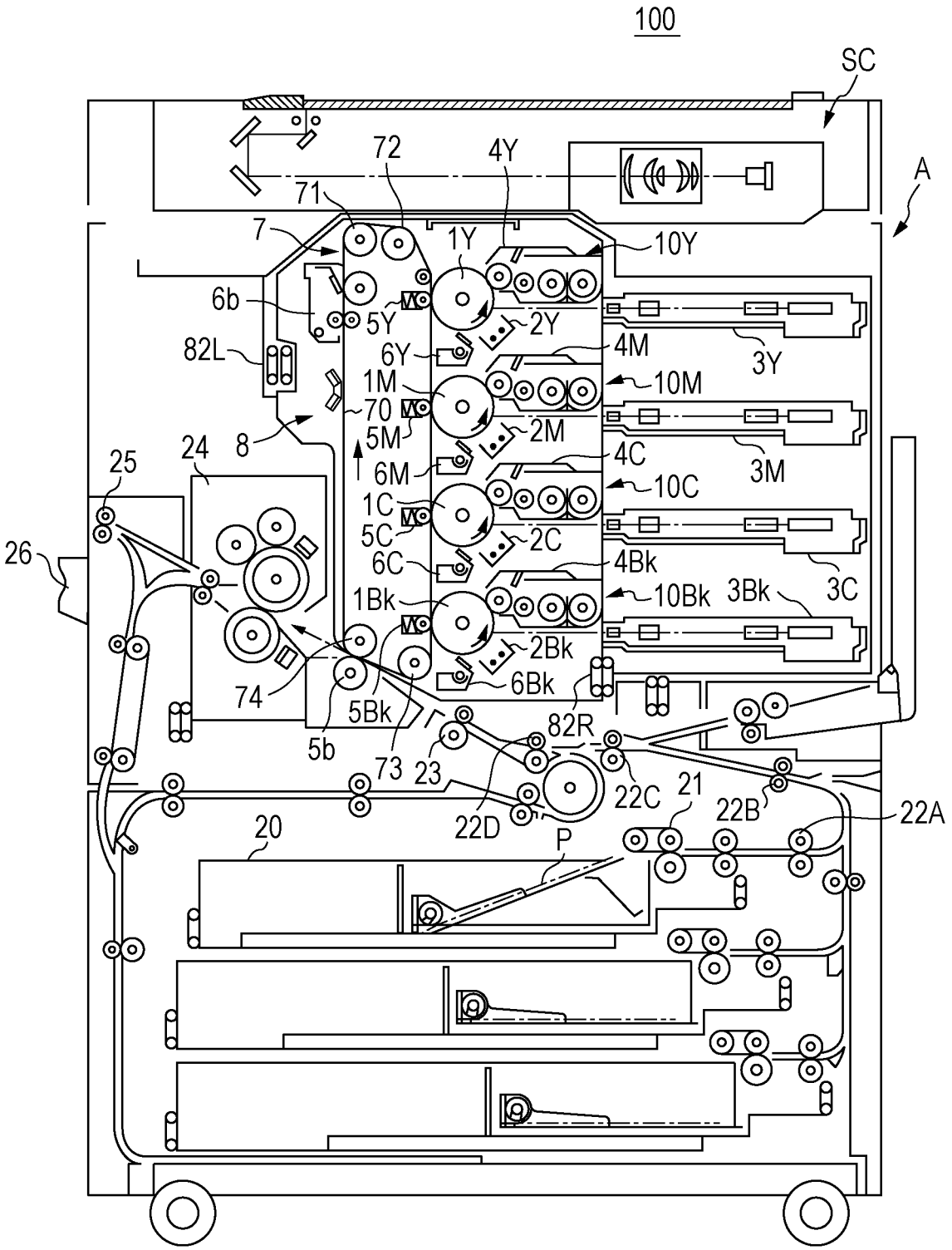
FIG. 1 is a schematic illustration showing an overall configuration of an image forming apparatus according to an embodiment.

Hereinafter, one or more embodiments of the present invention will be described with reference to the drawings. However, the scope of the invention is not limited to the disclosed embodiments. In the drawings, the same constituent will be denoted by the same sign, and repeated descriptions will be eliminated from the description of the drawings. Dimension ratios of the drawings are exaggerated for the purpose of illustration, and thus the ratios are sometimes different from actual ratios. Herein, the expression "X to Y" showing a range includes "X" and "Y", and has a meaning of "X or more and Y or less". Herein, operations and measurements of, for example, physical properties will be carried out under conditions at room temperature (20 to 25° C.) and a relative humidity of 40 to 50% RH.

Embodiment

An image forming apparatus according to an embodiment of the present invention will be described with reference to attached drawings below. However, the present invention is not limited to the embodiment described below.

FIG. 1 is a schematic cross-sectional view showing an exemplary configuration of an electrophotographic type image forming apparatus 100 according to an embodiment of the present invention. The image forming apparatus 100 has an apparatus body A and a document scanner SC that is disposed in an upper part of the apparatus body A. The image forming apparatus 100 is, for example, a tandem color image forming apparatus. The apparatus body A has, for example, four image forming units 10Y, 10M, 10C, and 10Bk, an endless-belt intermediate transferring unit 7, a sheet feeding cassette 20, a sheet feeder 21, a register roller 23, and a fixer 24.

(Image Forming Unit)

In the image forming unit 10Y, a yellow image is formed. This image forming unit 10Y includes a drum-shaped photoreceptor 1Y, a charger 2Y, an exposurer 3Y, a developer 4Y, a first transferring roller (first transferer) 5Y, and a cleaner 6Y. The charger 2Y, the exposurer 3Y, the developer 4Y, the first transferring roller (first transferer) 5Y, and the cleaner 6Y are arranged around the photoreceptor 1Y in this order in a rotation direction of the photoreceptor 1Y (in a direction of the arrow in FIG. 1, that is, for example, in a counterclockwise direction on the plane of this figure).

In the image forming unit 10M, a magenta image is formed. This image forming unit 10M includes a drum-shaped photoreceptor 1M, a charger 2M, an exposurer 3M, a developer 4M, a first transferring roller (first transferer) 5M, and a cleaner 6M. The charger 2M, the exposurer 3M, the developer 4M, the first transferring roller (first transferer) 5M, and the cleaner 6M are arranged around the photoreceptor 1M in this order in a rotation direction of the photoreceptor 1M.

In the image forming unit 10C, a cyan image is formed. This image forming unit 10C includes a drum-shaped photoreceptor 1C, a charger 2C, an exposurer 3C, a developer 4C, a first transferring roller (first transferer) 5C, and a cleaner 6C. The charger 2C, the exposurer 3C, the developer 4C, the first transferring roller (first transferer) 5C, and the cleaner 6C are arranged around the photoreceptor 1C in this order in a rotation direction of the photoreceptor 1C.

In the image forming unit 10Bk, a black image is formed. This image forming unit 10Bk includes a drum-shaped photoreceptor 1Bk, a charger 2Bk, an exposurer 3Bk, a developer 4Bk, a first transferring roller (first transferer) 5Bk, and a cleaner 6Bk. The charger 2Bk, the exposurer 3Bk, the developer 4Bk, the first transferring roller (first transferer) 5Bk, and the cleaner 6Bk are arranged around the photoreceptor 1Bk in this order in a rotation direction of the photoreceptor 1Bk.

The image forming units 10Y, 10M, 10C, and 10Bk are configured in a similar manner except that colors of toner images formed on the photoreceptors 1Y, 1M, 1C, and 1Bk are different from each other. Accordingly, the image forming unit 10Y will be described in detail, and descriptions of the image forming units 10M, 10C, and 10Bk will be omitted.

Figure 2:
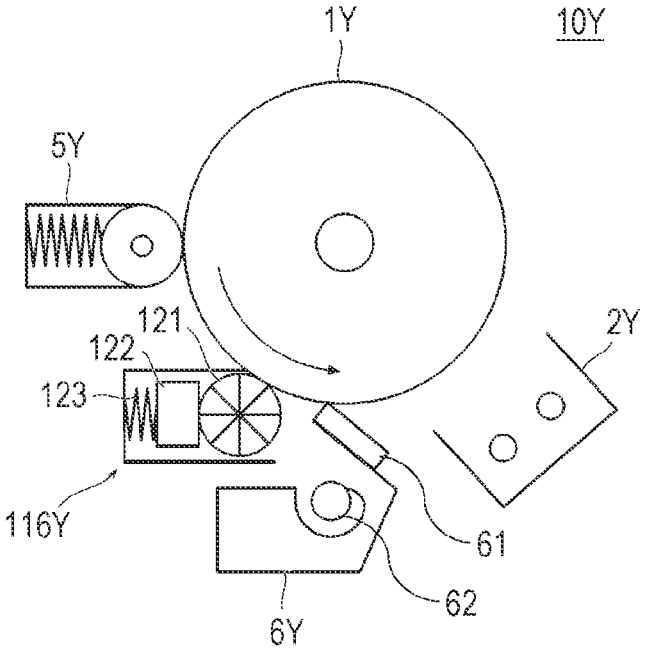
FIG. 2 is an illustration showing an exemplary configuration of an important part of an image forming unit shown in FIG. 1.

FIG. 2 is a cross-sectional view illustrating an exemplary configuration of an important part of the image forming unit 10Y. In the image forming unit 10Y, a yellow (Y) toner image is formed on the photoreceptor 1Y. In the image forming unit 10Y, for example, at least the photoreceptor 1Y, the charger 2Y, the developer 4Y, and the cleaner 6Y are integrated. The image forming unit 10Y, for example, further has a lubricant feeder 116Y between the first transferring roller 5Y and the cleaner 6Y, which are disposed around the photoreceptor 1Y.

A specific configuration of the photoreceptor 1Y will be described later.

The charger 2Y plays a role in providing a uniform electric potential to the photoreceptor 1Y. The charger 2Y is constituted by, for example, a noncontact charging unit. Examples of the noncontact charging unit include a corona discharge-type electrifying device such as a scorotron.

The exposurer 3Y (FIG. 1) performs exposure on the photoreceptor 1Y, on which the uniform electric potential has been provided by the charger 2Y, according to an image signal (yellow). Then, the exposurer 3Y produces an electrostatic latent image corresponding to a yellow image. The exposurer 3Y has, for example, a light-emitting device and an imaging element that are arranged in the axis direction of the photoreceptor 1Y to form an array. The light-emitting device contains, for example, light emitting diode (LED) or the like. The exposurer 3Y may have a laser optical system.

The developer 4Y (FIG. 1), for example, includes a developing sleeve and a voltage-applying device. The developing sleeve includes a built-in magnet. The developing sleeve rotates while retaining a developing agent. The voltage-applying device applies a direct current and/or alternating current bias voltage between the developing sleeve and the photoreceptor 1Y.

The first transferring roller 5Y transfers the toner image formed on the photoreceptor 1Y onto an endless-belt type intermediate transfer body 70. The first transferring roller 5Y is disposed so as to abut against the intermediate transfer body 70. In this configuration, the first transferring roller 5Y corresponds to a specific example of a transferer of the present invention, and the intermediate transfer body 70 corresponds to a specific example of an image receiving material of the present invention.

The lubricant feeder 116Y feeds (applies) a lubricant (lubricant 122 described below) to a surface of the photoreceptor 1Y. For example, the lubricant feeder 116Y is disposed, on a downstream side of the first transferring roller 5Y and an upstream side of the cleaner 6Y. For example, the lubricant feeder 116Y may be disposed on other positions, such as a downstream side of the cleaner 6Y. The lubricant feeder 116Y has a brush roller 121, a solid lubricant 122, and a pressure spring 123.

The brush roller 121 applies the lubricant 122 onto the surface of the photoreceptor 1Y. The brush roller 121 is formed with ribbon-shaped fabric of pile woven fabric, which is formed by weaving bundles of fibers as pile yarn into base fabric. The ribbon-shaped fabric is wound around a metal shaft in a spiral fashion such that the pile raising surface faces outward, and bonded to the shaft to form the brush roller 121. In this brush roller 121, for example, brush fibers made of a resin such as polypropylene are densely grafted onto a long length of woven fabric, and this woven fabric is disposed on the circumferential surface of the body of the roller.

As brush bristles, vertical type bristles are preferred from the viewpoint of lubricant application performances. The vertical type bristles are raised perpendicular to the metal shaft. As yarn used for the brush bristles, filament yarn is preferred. Examples of the material of the yarn include synthetic resins such as polyamides such as 6-nylon and 12-nylon, polyesters, acryl resins, and vinylon. For the purpose of increasing conductivity, carbon or a metal such as nickel may be kneaded into the material. Preferably, the thickness of brush fibers is, for example, 3 to 7 denier, the length of the brush fibers is, for example, 2 to 5 mm, the electrical resistance of the brush fibers is, for example, $1\times10^{10}\Omega$ or less, the Young's modulus of the brush fibers is, for example, 4900 to 9800 $N/mm^2$, and the density of the grafted brush fibers (the number of brush fibers per unit area) is, for example, 50,000 to 200,000 fibers per square inch (50,000 to 200,000 fibers/$inch^2$). The depth of penetration of the brush roller 121 into the photoreceptor 1Y is preferably 0.5 to 1.5 mm. The rotational speed of the brush roller 121 is, for example, 0.3 to 1.5 times as fast as the peripheral speed of the photoreceptor 1Y. The rotation direction of the brush roller 121 may be the same direction as the rotation direction of the photoreceptor 1Y, and may be the opposite direction to the rotation direction of the photoreceptor 1Y.

The pressure spring 123 presses the brush roller 121 against the photoreceptor 1Y via the lubricant 122. For example, the pressure spring 123 presses the lubricant 122 such that the pressure applied from the brush roller 121 to the photoreceptor 1Y falls within a range of 0.5 to 1.0 N.

In the lubricant feeder 116Y, in order to control the consumption of the lubricant 122 within a desired range, for example, the pressure applied from the lubricant 122 to the brush roller 121 and the rotational speed of the brush roller 121 are controlled. For example, the consumption of the lubricant 122 per kilometer of cumulative length of the surface of the photoreceptor 1Y is preferably 0.04 to 0.27 g/km, and more preferably 0.04 to 0.15 g/km.

The lubricant 122 is not particularly limited to a specific type, and publicly known lubricants can be appropriately selected. However, the lubricant 122 preferably contains a metal salt of fatty acid.

The metal salt of fatty acid is preferably a metal salt of a saturated or unsaturated fatty acid having 10 or more carbon atoms. Examples of the metal salt of fatty acid include zinc laurate, barium stearate, lead stearate, iron stearate, nickel stearate, cobalt stearate, copper stearate, strontium stearate, calcium stearate, cadmium stearate, magnesium stearate, zinc stearate, aluminum stearate, indium stearate, potassium stearate, lithium stearate, sodium stearate, zinc oleate, magnesium oleate, iron oleate, cobalt oleate, copper oleate, lead oleate, manganese oleate, aluminum oleate, zinc palmitate, cobalt palmitate, lead palmitate, magnesium palmitate, aluminum palmitate, calcium palmitate, lead caprate, zinc linolenate, cobalt linolenate, calcium linolenate, zinc ricinoleate, and cadmium ricinoleate. Among these, from the viewpoint of efficacy as a lubricant, availability, cost, and the like, zinc stearate is particularly preferred.

Although the lubricant feeder 116Y in the above description applies the solid lubricant 122 to the surface of the photoreceptor 1Y with the brush roller 121, the lubricant feeder 116Y may externally add lubricant fine particles to a toner base particle during preparation of a toner. In such a lubricant feeder 116Y, by the effect of development electric field created by the developer 4Y, the lubricant is fed to the surface of the photoreceptor 1Y.

The cleaner 6Y includes a blade 61 and a screw 62. The blade 61 is a flat plate-shaped member that abuts against the surface of the photoreceptor 1Y and cleans the surface of the photoreceptor 1Y. The blade 61 has a flat plate shape and extends in a direction of a rotation axis of the photoreceptor 1Y. The blade 61 abuts against the photoreceptor 1Y such that the blade points in the counter direction to the rotation direction of the photoreceptor 1Y. This blade 61 presses the surface of the photoreceptor 1Y, and scrapes off the toner that has not been transferred and remains on the surface of the photoreceptor 1Y (the residual toner) or the like. The residual toner or the like that has been scraped from the surface of the photoreceptor 1Y (the residual toner) is, for example, discharged from the image forming apparatus 100 by the screw 62. The brush roller 121 may scrape off the residual toner on the surface of the photoreceptor 1Y (the residual toner) together with the blade 61.

Figure 3:
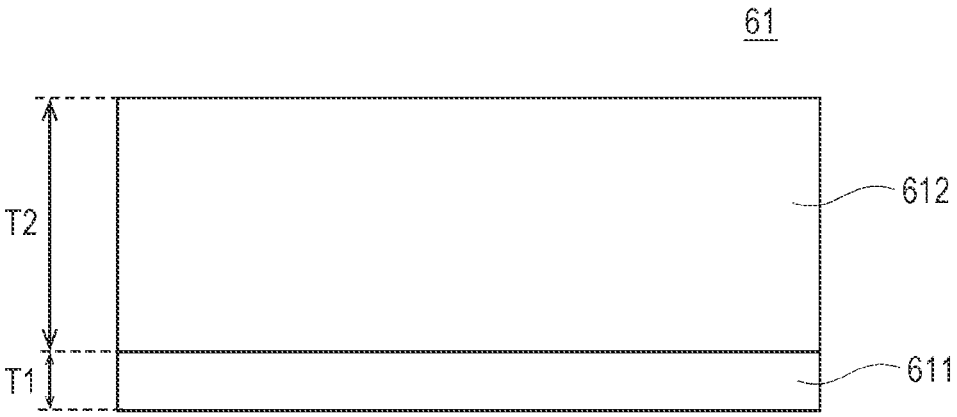
FIG. 3 is a schematic illustration showing a cross-sectional constitution of a blade shown in FIG. 2.

FIG. 3 shows a cross-sectional constitution of apart of the blade 61. The blade 61 has, for example, a multilayer configuration composed of two layers formed by an abutting layer 611 and a supporting layer 612. The abutting layer 611 abuts against the surface of the photoreceptor 1Y, and the abutting layer 611 is interposed between the supporting layer 612 and the surface of the photoreceptor 1Y. The blade 61 is supported by, for example, a support member (not shown) on a supporting layer 612 side. The abutting layer 611 and the supporting layer 612 contain, for example, an elastic rubber material such as polyurethane. In this configuration, the photoreceptor 1Y corresponds to a specific example of a toner image retainer of the present invention, and the blade 61 corresponds to a specific example of a blade of the present invention.

It is preferred that the blade 61 stably maintains the abutting state against the surface of the photoreceptor 1Y even under varying operating conditions including temperature, humidity, and frequency. This minimizes deterioration in cleaning characteristics, and desired cleaning characteristics can be easily maintained.

In this embodiment, the maximum value D of a difference between a first loss tangent (Tan δ) at 1 Hz and a second loss tangent (Tan δ) at 100 Hz of the blade 61 satisfies the following formula (1):

[Mathematical Formula 4]

$$0.2 \leq D \leq 0.7 \quad (1)$$

Here, the maximum value D is a maximum value of the difference between the first loss tangent and the second loss tangent at temperatures within a range of 0° C. to 50° C.

When the maximum value D does not satisfy the above-described formula (1), it may become difficult to stably maintain the abutting state of the blade against the surface of the photoreceptor because of environmental variations. For example, when the maximum value D is more than 0.7, the blade tends to show highly viscous characteristics. In this case, the abutting state of the blade against the surface of the photoreceptor may become unstable because of variations in temperature and variations in vibration derived from the machine (vibration in the machine), resulting in insufficient removal of the residual toner or the like on the surface of the photoreceptor. On the other hand, when the maximum value D is less than 0.2, the blade tends to show highly elastic characteristics. In this case, vibration of the blade itself, that is, so-called stick-slip tends to occur, resulting in an unstable abutting state of the blade against the surface of the photoreceptor. When the maximum value D is caused to satisfy the above-described formula (1), the abutting state of the blade 61 against the photoreceptor 1Y while the blade 61 cleans the photoreceptor 1Y can be stably maintained even under varying operating conditions (detailed descriptions will be given later). Here, the first loss tangent and the second loss tangent are represented by dynamic loss elastic modulus/dynamic storage elastic modulus.

Figure 4:
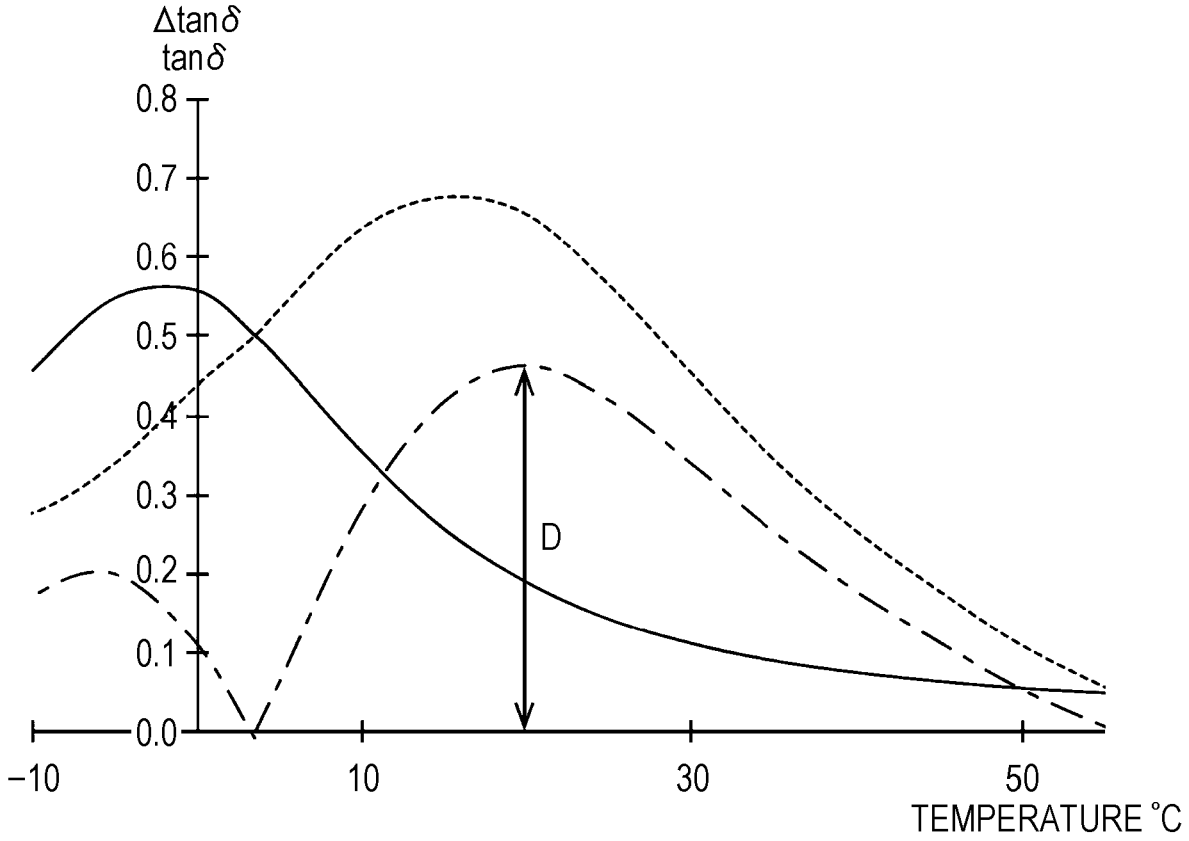
FIG. 4 is a graph for describing a first loss tangent, a second loss tangent, and a maximum value of the blade shown in FIG. 3.

FIG. 4 represents an example of the maximum value D of a first loss tangent and a second loss tangent. In FIG. 4, the vertical axis represents a loss tangent (Tan δ), and the horizontal axis represents temperature (° C.). The solid line in FIG. 4 represents a loss tangent of the blade 61 at 1 Hz, that is, a temperature-dependent change in the first loss tangent. The broken line in FIG. 4 represents a loss tangent of the blade 61 at 100 Hz, that is, a temperature-dependent change in the second loss tangent. The dot-and-dash line in FIG. 4 represents the difference between the first loss tangent and the second loss tangent. In this example shown in FIG. 4, the difference between the first loss tangent and the second loss tangent has a maximum point around a temperature of 20° C., and the maximum value D is about 0.45.

The maximum value D as described above preferably also satisfies the following formula (2). As a result of this, the abutting state of the blade 61 against the photoreceptor 1Y can be more stably maintained.

[Mathematical Formula 5]

$$0.35 \leq D \leq 0.55 \quad (2)$$

In the blade 61, the abutting layer 611 that abuts against the surface of the photoreceptor 1Y preferably has a thickness (thickness T1 in FIG. 3) of 0.2 mm or more and 1.2 mm or less, and more preferably has a thickness of 0.4 mm or more and 1.0 mm or less. As a result of this, as compared to the case in which the thickness T1 of the abutting layer 611 is larger than 1.2 mm, the abutting state of the blade 61 against the photoreceptor 1Y can be more stably maintained.

The maximum value D1, which is the difference between a third loss tangent at 1 Hz and a fourth loss tangent at 100 Hz of the abutting layer 611, preferably satisfies the following formula (3). As a result of this, as compared to the case in which the maximum value D1 does not satisfy formula (3), the abutting state of the blade 61 against the photoreceptor 1Y can be more stably maintained.

[Mathematical Formula 6]

$$0.45 \leq D1 \leq 0.90 \quad (3)$$

Here, the maximum value D1 is a maximum value of the difference between the third loss tangent and the fourth loss tangent at temperatures within a range of 0° C. to 50° C.

The supporting layer 612 that supports the abutting layer 611 preferably has a thickness (thickness T2 in FIG. 3) that is larger than the thickness T1 of the abutting layer 611, and, for example, preferably has a thickness T2 that is three times or more and four times or less as large as the thickness T1 of the abutting layer 611. For example, the thickness T2 of the supporting layer 612 is preferably 0.6 mm or more and 2.0 mm or less, and more preferably 0.8 mm or more and 1.8 mm or less. As a result of this, as compared to the case in which the thickness T2 of the supporting layer 612 is smaller than 0.6 mm, the abutting state of the blade 61 against the photoreceptor 1Y can be more stably maintained.

The maximum value D2, which is the difference between a fifth loss tangent at 1 Hz and a sixth loss tangent at 100 Hz of the supporting layer 612, is preferably smaller than the maximum value D1, and preferably satisfies the following formula (4). As a result of this, as compared to the case in which the maximum value D2 does not satisfy the formula (4), the abutting state of the blade 61 against the photoreceptor 1Y can be more stably maintained.

[Mathematical Formula 7]

$$0.35 \leq D2 \leq 0.60 \quad (4)$$

Here, the maximum value D2 is a maximum value of the difference between the fifth loss tangent and the sixth loss tangent at temperatures within a range of 0° C. to 50° C.

When the maximum values D1 and D2 satisfy the above-described formulae (3) and (4), respectively, the abutting state of the blade 61 against the photoreceptor 1Y can be more stably maintained.

(Method of Producing Blade)

Figure 5A:
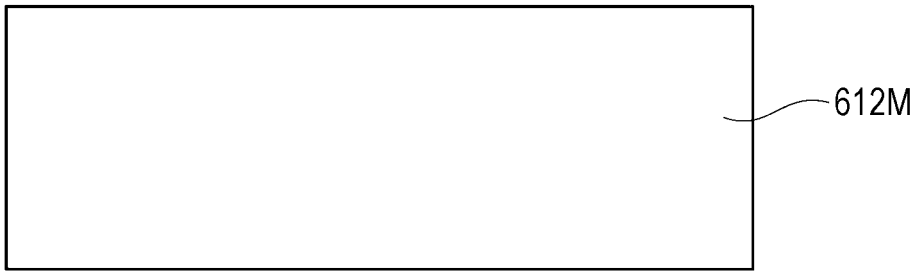
FIG. 5A is a cross-sectional view illustrating one of the steps of a method of producing the blade shown in FIG. 3.
Figure 5B:
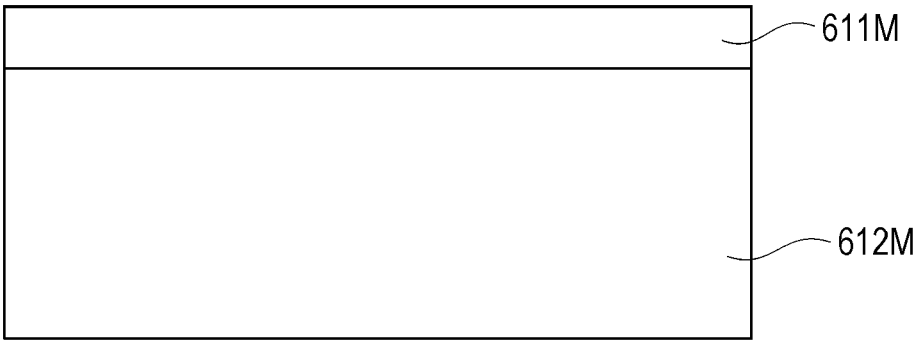
FIG. 5B is a cross-sectional view illustrating a step following the step of FIG. 5A.

FIG. 5A and FIG. 5B represent an example of a process of producing the blade 61. The blade 61 can be produced, for example, as follows.

First, a sheet 612M that is used as the supporting layer 612 is formed (FIG. 5A). The sheet 612M is formed of, for example, polyurethane, and formed by using a publicly known method of shaping polyurethane. For example, the sheet 612M can be formed as follows. Polyol and isocyanate are subjected to a dehydration treatment, and thereafter mixed and reacted with each other at a temperature of 70 to 140° C. for 10 to 120 minutes. This yields a prepolymer. As the polyol, for example, polycaprolactam, polyethylene adipate, polybutylene adipate, and polyethylene butylene adipate can be used, and, alternatively, other polyols may be used. The polyols may be used alone, or in combination of two or more. As the isocyanate, for example, tolylene diisocyanate, 4,4-diphenylmethane diisocyanate (MDI), hexamethylene diisocyanate, isophorone diisocyanate, 1,4-cyclohexane diisocyanate, and isomers of the foregoing can be used, and, alternatively, other isocyanates may be used. The isocyanates may be used alone, or in combination of two or more. After the formation of the prepolymer, for example, a cross-linker is added to the prepolymer. The cross-linker used above is preferably a mixture of a low molecular weight diol and a low molecular weight triol. As the low molecular weight diol, for example, 1,4-butanediol, ethylene glycol, diethylene glycol, 1,6-hexanediol, and neopentyl glycol can be used, and, alternatively, other low molecular weight diols may be used. As the low molecular weight triol, for example, trimethylolpropane and triisopropanolamine can be used, and, alternatively, other low molecular weight triols may be used. After the addition of, for example, a cross-linker to the prepolymer, the resulting mixture is injected into a die of a centrifugal molding machine preheated to 150° C., and cured for 5 to 10 minutes. This forms the sheet 612M. The sheet 612M has a thickness of, for example, 0.6 mm or more and 2.0 mm or less.

Next, on the sheet 612M formed in the die, a sheet 611M that is used as the abutting layer 611 is formed (FIG. 5B). The sheet 611M is formed of, for example, polyurethane, and can be formed as in the above-described sheet 612M. Specifically, to pretreated polyol and isocyanate, a cross-linker is added. Then, the resulting mixture is injected into a die, and cured on the cured sheet 612M. The mixture is cured for, for example, 25 to 50 minutes. This produces a laminate of the sheets 611M and 612M in the die. The sheet 611M has a thickness of, for example, 0.2 mm or more and 1.2 mm or less.

Thereafter, the laminate of the sheets 611M and 612M is removed from the die, and cut into a desired shape. Accordingly, the blade 61 composed of the abutting layer 611 and the supporting layer 612 is produced.

In the above-described method of producing a blade, the supporting layer 612 is prepared first, and then the abutting layer 611 is bound to the supporting layer 612. However, in a method of producing a blade according to the present invention, the blade can be produced by preparing the abutting layer 611 first, and then binding the supporting layer 612 to the abutting layer 611. In this case, the abutting layer 611 and the supporting layer 612 are formed as in the above-described method.

(Endless-Belt Intermediate Transferring Unit)

The endless-belt intermediate transferring unit 7 has, for example, an endless-belt type intermediate transfer body 70, a plurality of rollers 71 to 74, and a cleaner 6*b* (FIG. 1). The intermediate transfer body 70 is wound around the rollers 71 to 74 and supported by the rollers 71 to 74. The intermediate transfer body 70 is revolved by rotation of the rollers 71 to 74, for example, in a clockwise direction (in the direction of the arrow in FIG. 1). A toner image (full color) transferred from first transferring rollers 5Y, 5M, 5C, and 5Bk to the intermediate transfer body 70 is transferred by a second transferer 5*b* to, for example, a sheet P. The second transferer 5*b* is disposed, for example, at a position that allows the second transferer 5*b* to face the roller 74. The cleaner 6*b* cleans off the residual toner or the like that has not been transferred and remains on the surface of the intermediate transfer body 70. The cleaner 6*b* has, for example, a blade that abuts against the surface of the intermediate transfer body 70.

The image forming units 10Y, 10M, 10C, and 10Bk and the endless-belt intermediate transferring unit 7 are, for example, accommodated in a housing 8. The housing 8 is configured such that the housing 8 can be pulled out from the apparatus body A with the help of supporting rails 82L and 82R.

(Sheet Feeding Cassette)

The sheet feeding cassette 20 carries a plurality of sheets P. The image forming apparatus 100 is, for example, provided with a plurality of sheet feeding cassettes 20.

(Sheet Feeder)

The sheet feeder 21 delivers, for example, a sheet P stacked on the top of the sheets P installed in the sheet feeding cassette 20 to a sheet transporting route. The sheet feeder 21 has, for example, a feed roller. The sheet feeder 21 can be an air suction sheet feeder.

A plurality of intermediate rollers 22A, 22B, 22C, and 22D are provided in a sheet transporting route between the sheet feeder 21 and the register roller 23. The intermediate rollers 22A, 22B, 22C, and 22D are each constituted by a pair of conveying rollers. For example, the intermediate roller 22A, the intermediate roller 22B, the intermediate roller 22C, and the intermediate roller 22D are arranged in this order from the sheet feeder 21 side.

(Register Roller)

The register roller 23 is provided in a sheet transporting route between the intermediate roller 22D and the second transferer 5*b*. The register roller 23 is composed of, for example, a pair of rollers including a register driving roller and a register driven roller.

(Fixer)

The fixer 24 is, for example, a heat roller fixing type fixer, and has a heating roller and a pressure roller. The heating roller includes a heat source therein. The pressure roller is provided so as to abut against the heating roller, and a fixing nip portion is formed between the heating roller and the pressure roller.

In the above-described embodiment, the image forming apparatus 100 is a color printer. However, the image forming apparatus 100 can be a monochrome printer, a copier, a multifunctional machine, or the like.

The image forming apparatus 100 may further include, if necessary, a lubricant removing section (not shown) that removes the lubricant 122 from the surfaces of the photoreceptors 1Y, 1M, 1C, and 1Bk. For example, a lubricant feeder 116Y may be disposed on a downstream side of the cleaner 6Y and an upstream side of the charger 2Y in a rotation direction of the photoreceptor 1Y, and a lubricant removing section may be further disposed on a downstream side of this lubricant feeder 116Y and an upstream side of the charger 2Y.

The lubricant removing section has, for example, a removing member. For example, this removing member comes into contact with the surface of the photoreceptor 1Y, and removes the lubricant 122 by a mechanical action. As the removing member, for example, a brush roller, a foam roller, or the like can be used.

(Toner)

A constitution of the toner that is applied onto the surface of the photoreceptors 1Y, 1M, 1C, and 1Bk will be described below. The toner includes a toner base particle and metal oxide particles as an external additive that has been externally added to the toner base particle. That is, the toner particles include a toner base particle and external additive metal oxide particles.

Herein, the "toner base particle" constitutes the base of "toner particles". The "toner base particle" includes at least a binder resin, and, if necessary, may include other constituent elements such as a colorant, a release agent (wax), and a charge control agent. The "toner base particle" with the added external additive is called a "toner particle". The term "toner" refers to an aggregation of the "toner particles".

The composition and constitution of the toner base particle are not particularly limited, and publicly known toner base particles can be appropriately used. Examples of the toner base particle include toner base particles described in, for example, JP 2018-72694 A and JP 2018-84645 A.

The binder resin is not particularly limited. Examples of the binder resin include amorphous resins or crystalline resins. Herein, the amorphous resins refers to a resin that does not have a melting point and has relatively high glass transition temperature (Tg) as measured by differential scanning calorimetry (DSC). The amorphous resin is not particularly limited, and publicly known amorphous resins can be used. Examples of the amorphous resin include vinyl resins, amorphous polyester resins, urethane resins, and urea resins. Among these, vinyl resins are preferred because thermoplasticity can be easily controlled. Any vinyl resin can be used without particular limitation as long as the vinyl resin is a polymerized product of a vinyl compound. Examples of the vinyl resin include (meth)acrylic ester resins, styrene-(meth)acrylic ester resins, and ethylene-vinyl acetate resins. Herein, the crystalline resin refers to a resin that has a distinct endothermic peak, rather than a stepwise endothermic change, in differential scanning calorimetry (DSC). The distinct endothermic peak specifically means a peak having a half width of the endothermic peak of within 15° C. as measured by differential scanning calorimetry (DSC) at a heating rate of 10° C./min. The crystalline resin is not particularly limited, and publicly known crystalline resins can be used. Examples of the crystalline resin include crystalline polyester resins, crystalline polyurethane resins, crystalline polyurea resins, crystalline polyamide resins, and crystalline polyether resins. Among these, crystalline polyester resins are preferred. Here, the term "crystalline polyester resin" refers to a resin that satisfies the above-described endothermic characteristics among publicly known polyester resins prepared by a polycondensation reaction of a di- or higher-valent carboxylic acid (polyvalent carboxylic acid) or a derivative thereof with a di- or higher-hydric alcohol (polyhydric alcohol) or a derivative thereof. These resins may be used alone, or in combination of two or more.

The colorant is not particularly limited, and publicly known colorants can be used. Examples of the colorant include carbon black, magnetic substances, dyes, and pigments.

The release agent is not particularly limited, and publicly known release agents can be used. Examples of the release agent include polyolefin waxes, branched hydrocarbon waxes, long-chain hydrocarbon waxes, dialkyl ketone-based waxes, ester waxes, and amide waxes.

The charge control agent is not particularly limited, and publicly known charge control agents can be used. Examples of the charge control agent include nigrosine dyes, metal salts of naphthenic acid or higher fatty acids, alkoxylated amines, quaternary ammonium salt compounds, azo metal complexes, and metal salts or metal complexes of salicylic acid.

The toner base particle may be a toner particle having a multi-layered structure, such as a core-shell structure composed of a core particle and a shell layer covering the entire surface of the core particle. It is not necessary that the shell layer covers the entire surface of the core particle. In other words, the core particle may be partially exposed. The cross-section of the core-shell structure can be observed by using a publicly known analytical instrument, such as a transmission electron microscope (TEM) or a scanning probe microscope (SPM).

The toner base particles have a number median diameter (D50) of more than 0 nm, and the number median diameter (D50) is preferably, but not particularly limited to, 3,000 nm or more and 10,000 nm or less, and more preferably 4,000 nm or more and 7,000 nm or less. When the number median diameter (D50) is within the above-described range, an approximated spherical toner particle diameter $R_3$ (described later) can be more easily caused to fall within a preferred range.

The number median diameter (D50) of the toner base particles can be measured by using a precise particle size distribution analyzer (Multisizer 3: manufactured by Beckman Coulter, Inc.). When the toner particles contain external additives, the number median diameter (D50) of the toner base particles can be measured by removing the external additives before measurement.

For example, the median diameter (D50) of toner particles containing external additives is measured according to the following procedure. Toner particles (0.02 g) are soaked in 20 mL of a surfactant solution (e.g., a surfactant solution for dispersing toner particles, in which a neutral detergent containing a surfactant component is diluted ten times with pure water), and ultrasonically dispersed for 1 minute to prepare a toner base particle dispersion. This toner base particle dispersion is injected using a pipette into ISOTON II (manufactured by Beckman Coulter, Inc.) in a beaker held by a sample stand until the measured concentration reaches 5 to 10 mass %. When the concentration is within the above-described range, reproducible measurements can be achieved. Then, particle size distribution is measured using a precise particle size distribution analyzer (Multisizer 3: manufactured by Beckman Coulter, Inc.) with the following setting: counts of particles to be measured of 25,000, and an aperture diameter of 100 μm. The range of the measurement from 1 to 30 μm is divided into 256 subranges to count the number of particles that fall within each of the subranges. The particle diameter of a particle in which the number of particles that are larger than or equal to the particle diameter is 50% in the cumulative distribution curve is defined as a number median diameter (D50).

The number median diameter (D50) of the toner base particles can be controlled by the type of raw material particle used, the amount of the raw material particle added, the reaction temperature, and the reaction time in a particle growth reaction in the production of the toner base particles.

In an aspect of the present invention, the external additive contains metal oxide particles (external additive metal oxide particles). The external additive metal oxide particles have a function of reducing electrostatic and physical adhesive force between the first transferring roller 5Y or second transferer 5*b* and a toner to improve transfer properties. The external additive metal oxide particles also have a function of increasing efficiency in removal of the residual toner to improve cleaning characteristics and reduce abrasion of the photoreceptors 1Y, 1M, 1C, and 1Bk and the blade 61.

In particular, in rough paper that has a rugged surface (e.g., embossed paper), a toner cannot be easily transferred in recessed parts as compared to raised parts. Thus, to improve transfer properties to the recessed parts, electrostatic and physical adhesive force between a transfer member and a toner is reduced by external additives contained in the toner. Here, as described later, since liberation of external additives can be prevented, excellent transfer properties to rough paper can be achieved. Thus, the image forming apparatus 100 is suitable for use in image formation on rough paper.

Examples of the metal oxide that constitutes the external additive metal oxide particles include, but are not particularly limited to, silica (silicon oxide), magnesium oxide, zinc oxide, lead oxide, alumina (aluminum oxide), tin oxide, tantalum oxide, indium oxide, bismuth oxide, yttrium oxide, cobalt oxide, copper oxide, manganese oxide, selenium oxide, iron oxide, zirconium oxide, germanium oxide, tin oxide, titanium dioxide, niobium oxide, molybdenum oxide, vanadium oxide, and copper aluminum oxide and antimony-doped tin oxide. Among these, silica ($SiO_2$) particles, alumina ($Al_2O_3$) particles, and titanium dioxide ($TiO_2$) particles are preferred, and silica particles are more preferred. These metal oxide particles may be used alone, or in combination of two or more.

Herein, among the external additive metal oxide particles, external additive metal oxide particles having the largest number average primary particle size are called "large-diameter particles". It should be noted that when a single type of external additive metal oxide particles are used, these metal oxide particles are, of course, large-diameter particles. When two or more types of metal oxide particles having the same number average primary particle size are used, all of the metal oxide particles are large-diameter particles. For example, as the number average primary particle size of large-diameter particles becomes larger, an average height of raised parts of external additives (described later) becomes larger, and moreover, an approximated spherical toner particle diameter $R_3$ (described later) also becomes larger.

The number average primary particle size of the large-diameter particles is preferably, but not particularly limited to, 10 nm or more, more preferably 50 nm or more, and still more preferably 70 nm or more. Further, the number average primary particle size of the large-diameter particles is preferably, but not particularly limited to, 300 nm or less, more preferably 200 nm or less, and still more preferably 150 nm or less. When the number average primary particle size is within the above-described range, an approximated spherical toner particle diameter $R_3$ (described later) can be more easily caused to fall within a preferred range. That is, at least one type of the external additive metal oxide particles preferably has a number average primary particle size of 70 nm or more and 150 nm or less.

Here, the number average primary particle size of large-diameter particles can be calculated as follows. A photographic image of a toner captured using a scanning electron microscope (SEM) ("JSM-7401F", manufactured by JEOL Ltd.) is read with a scanner, and large-diameter particles in the photographic image are binarized with an image processing and analysis device ("LUZEX AP", manufactured by NIRECO CORPORATION). The horizontal Feret diameters of 50 large-diameter particles per one toner particle are calculated, and the top-10 values are adopted. The above-described horizontal Feret diameter calculation is performed on the total number of 10 toner particles, and the average of the 100 horizontal Feret diameters of large-diameter particles adopted above is defined as a number average primary particle size.

In the above measurement, when metal oxide particles observed in a photographic image have the same composition and crystal structure, the metal oxide particles are classified into the same type of metal oxide particles. When at least one of the composition or crystal structure is different from each other, the metal oxide particles are classified into different types of metal oxide particles.

The number average primary particle size of external additive metal oxide particles other than the large-diameter particles has small influence on the average height of raised parts of external additives and the approximated spherical toner particle diameter $R_3$ (described later), and is not particularly limited. The a number average primary particle size of the external additive metal oxide particles other than large-diameter particles can be calculated as described above except that the target particles are different.

The amount by mass of the large-diameter particles relative to the total mass of external additive metal oxide particles is more than 0 mass %, and preferably, but not particularly limited to, 50 mass % or more, more preferably 60 mass % or more, and still more preferably 70 mass % or more. Further, the amount by mass of the large-diameter particles relative to the total mass of external additive metal oxide particles is preferably, but not particularly limited to, 100 mass % or less, more preferably 99 mass % or less, still more preferably 90 mass % or less, and particularly preferably 80 mass % or less. When the amount by mass of the large-diameter particles is within the above-described range, an approximated spherical toner particle diameter $R_3$ (described later) can be more easily caused to fall within a preferred range while a desired function as a toner is achieved.

The external additives may further contain inorganic particles other than metal oxide particles, organic particles, and lubricant fine particles.

For example, the approximated spherical toner particle diameter $R_3$ is defined by the diameter of the toner base particle and the average height of raised parts of external additives as described below. The approximated spherical toner particle diameter $R_3$ is more than 0 nm, and preferably, but not particularly limited to, 2000 nm or more and 5000 nm or less, and more preferably 2500 nm or more and 3500 nm or less. When the approximated spherical toner particle diameter $R_3$ is within the above-described range, the maximum average distances between raised parts $R_2'$ (described later) can be within a preferred range.

$$R_3\ [\text{nm}] = (\text{diameter of toner base particle [nm]} + \text{average height of raised parts of external additives [nm]} \times 2)/2 \quad \text{[Mathematical Formula 8]}$$

The approximated spherical toner particle diameter $R_3$ can be calculated as follows. With respect to a toner, 3D measurement of the toner is carried out using a surface roughness analysis 3D scanning electron microscope ("ERA-600FE", manufactured by ELIONIX INC.), and the surface roughness of the toner is analyzed by 3D analysis to calculate the average height of raised parts from the surface of the toner base particle (average height of raised parts of external additives (nm)).

Next, by using the calculated average height of raised parts of external additives (nm) and the above-described number median diameter (D50) of the toner base particles (nm) as a diameter, the approximated spherical toner particle diameter $R_3$ is calculated according to the above-described formula.

It has been confirmed that the average height of raised parts of external additives is principally connected with the average particle size of large-diameter particles. Thus, it is speculated that the raised parts formed by large-diameter particles have great influence on the average height of raised parts of external additives.

The above-described average height of raised parts of external additives is more than 0 inn, and preferably, but not particularly limited to, 5 nm or more and 60 nm or less, more preferably 10 nm or more and 50 nm or less, and still more preferably 20 nm or more and 40 nm or less. When the average height of raised parts of external additives is within the above-described range, the maximum average distances between raised parts $R_2'$ (described later) can fall within a preferred range.

An area of 70% or more of a toner base particle is covered with metal oxide particles as external additives. That is, coverage of a toner base particle with external additive metal oxide particles (hereinafter, also simply referred to as "coverage") is 70% or more.

Herein, the term "coverage of a toner base particle with metal oxide particles as external additives" refers to an area (%) occupied with external additive metal oxide particles on one toner particle relative to the surface area of the toner particle in a photographic image of a scanning electron microscope (SEM).

When the coverage is less than 70%, cleaning characteristics are particularly insufficient, and, in addition, transfer properties to rough paper is impaired. A speculated reason is as follows. When the toner base particle comes into contact with an outermost layer, adhesive force and frictional force between the toner and the outermost layer become larger. Accordingly, the impact force of the residual toner that smashes against the blade 61 becomes larger. In addition, the ease of removal of the residual toner from the outermost layer in cleaning is decreased. Thus, from the viewpoint of improving, in particular, cleaning characteristics, and, in addition, transfer properties to rough paper, the coverage is more preferably 75% or more (upper limit: 100%).

The coverage of the toner base particle can be calculated as follows. A photographic image of a toner captured using a scanning electron microscope (SEM) ("JSM-7401F", manufactured by JEOL Ltd.) is read with a scanner, and external additive metal oxide particles in the photographic image are binarized with an image processing and analysis device ("LUZEX AP", manufactured by NIRECO CORPORATION). Then, occupancy (%) that is the percentage of an area occupied with the external additive metal oxide particles on one toner particle relative to the surface area of the toner particle is calculated. The above-described calculation of occupancy is repeated for 10 toner particles in total, and the average of the calculated occupancies for the 10 toner particles is defined as a coverage (%) of the toner base particle.

The coverage can be controlled by, for example, a ratio of the amount of external additive metal oxide particles to the amount of toner base particle, and a combination of the type of toner base particle (in particular, binder resin) and the type of external additive metal oxide particles.

(Method of Producing Toner)

The method of producing a toner base particle is not particularly limited, and examples include publicly known methods such as kneading pulverization, suspension polymerization, emulsion coagulation, dissolution suspension, polyester extension, dispersion polymerization, and the like. Among these, from the viewpoint of uniformity of particle diameter and control of particle shape, emulsion coagulation is preferred. In the emulsion coagulation, the toner base particle is prepared as follows. A dispersion of binder resin particles dispersed by a surfactant or a dispersion stabilizer is mixed with a colorant particle dispersion if necessary. Then, these particles are aggregated to achieve a desired toner particle diameter, and the binder resin particles are fused to control particle shape and afford the toner base particle. Here, the binder resin particles may optionally contain a release agent, a charge control agent, and the like.

The external additives can be externally added to the toner base particles using a mechanical mixer. Examples of the mechanical mixer used herein include a Henschel mixer, a Nauta Mixer, a TURBULA mixer, or the like. Among these, a Henschel mixer, which can impart shear force to the particles treated, may be used to mix for a prolonged period of time, or may be used to mix with a stirring blade at an increased peripheral velocity. When two or more types of external additives are used in combination, all of the external additives may be mixed with the toner particles together, or the external additives may be divided and mixed with the toner particles separately depending on the external additives.

(Developing Agent)

The toner may be used as a magnetic or nonmagnetic one-component developing agent, or may be mixed with a carrier and used as a two-component developing agent.

When toner is used as a two-component developing agent, the carrier used in the two-component developing agent may be magnetic particles including publicly known materials, such as ferromagnetic metals such as iron; alloys of ferromagnetic metals and aluminum, lead, and the like; and compounds of ferromagnetic metals such as ferrite, magnetite, and the like. In particular, ferrite is preferred.

(Photoreceptor)

The photoreceptors 1Y, 1M, 1C, and 1Bk that retain toner images have, for example, an outermost layer formed of a polymerized and cured product of a composition containing a polymerizable monomer and an inorganic filler, and the surface of the outermost layer has raised structures constituted by protrusions of the inorganic filler.

Figure 6:
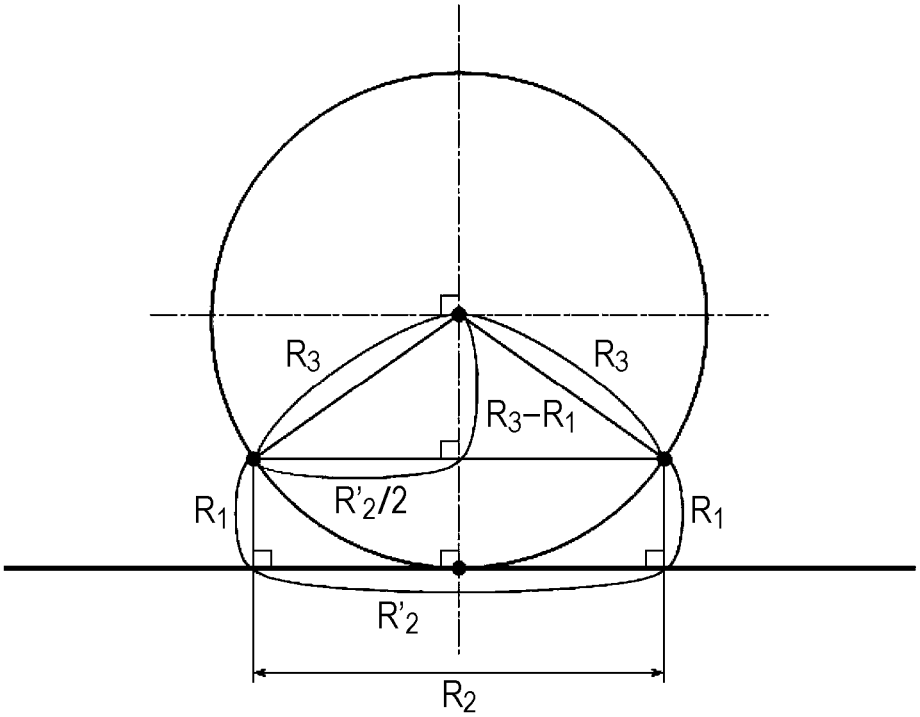
FIG. 6 is an illustration for describing a relationship between a photoreceptor and a toner shown in FIG. 2.

FIG. 6 is an illustration for describing a state in which a toner and the photoreceptors 1Y, 1M, 1C, and 1Bk are in contact with each other. In FIG. 6, $R_1$ represents an average height of raised parts (nm) of the outermost layer, $R_2$ represents an average distance between raised parts (nm) of the raised structures constituted by protrusions of the inorganic filler on the outermost layer, and $R_3$ represents an approximated spherical particle diameter (nm) of the toner. Here, it is preferred that the average height of raised parts $R_1$ (nm) of the outermost layer, the average distance between raised parts $R_2$ (nm) of raised structures constituted by protrusions of the inorganic filler on the outermost layer, and the approximated spherical particle diameter $R_3$ (nm) of the toner satisfy the relationships of the following formulae (5) to (7). $R_2'$ represents the maximum average distance between raised parts of the raised structures constituted by protrusions of the inorganic filler on the outermost layer (nm) calculated from the relationship between $R_1$ and $R_3$, and satisfies the following formula (8). Accordingly, cleaning characteristics can be improved, and abrasion of the photoreceptors 1Y, 1M, 1C, and 1Bk and the blade 61 can be reduced. Assumed mechanism is as follows.

[Mathematical Formula 9]

$$R_2 \leq 2\sqrt{2R_1R_3 - R_1^2} \quad (5)$$

$$0 < R_1 < R_3 \quad (6)$$

$$0 < R_2 \leq 250 \quad (7)$$

[Mathematical Formula 10]

$$R_2' = 2\sqrt{2R_1R_3 - R_1^2} \quad (8)$$

When the average distance between raised parts $R_2$ of the raised structures constituted by protrusions of the inorganic filler on the outermost layer satisfies the above-described formula (5), in other words, when the average distance between raised parts $R_2$ is equal to or less than the maximum average distances between raised parts $R_2'$, the toner mainly comes into contact with the raised structures on the outermost layer. As described above, the toner has metal oxide particles as an external additive, an area of 70% or more the toner base particle is covered with the external additive metal oxide particles, and the surface of the outermost layer has raised structures constituted by protrusions of the inorganic filler. Thus, between the toner and the outermost layers of the photoreceptors 1Y, 1M, 1C, and 1Bk, the external additive metal oxide particles that cover the toner base particle and the inorganic filler of the outermost layer mainly come into contact with each other.

On the other hand, when the average distance between raised parts $R_2$ exceeds the maximum value of average distances between raised parts $R_2'$, the toner particles mainly come into contact with the outermost layer at a part other than the raised structures. In this case, between the toner and the outermost layers of the photoreceptors 1Y, 1M, 1C, and 1Bk, the external additive metal oxide particles that cover the toner base particle and a resin part of the polymerized and cured product contained in the outermost layer mainly come into contact with each other.

The toner particles may include a toner base particle having a coverage with an external additive of less than 70%, or the toner particles may contain no external additive and consist only of a toner base particle. Between these toner particles and the outermost layer, the toner base particle and the outermost layer mainly come into contact with each other. In addition, some outermost layers may have a composition including no inorganic filler. Between these outermost layers and these toner particles, the toner particles and a resin part of the polymerized and cured product mainly come into contact with each other.

Adhesive forces and frictional forces caused by contact between these toners and these outermost layers in various contact patterns are compared as follows. When the adhesive force and the frictional force between the toner base particle and the resin part of the polymerized and cured product contained in the outermost layer, the adhesive force and the frictional force between the toner base particle and the inorganic filler contained in the outermost layer, the adhesive force and the frictional force between the external additive that covers the toner base particle and the resin part of the polymerized and cured product, and the adhesive force and the frictional force between the external additive and the inorganic filler are compared with each other, the adhesive force and the frictional force between the external additive and the inorganic filler are the smallest among them. That is, when the average distance between raised parts $R_2$ of the raised structures constituted by protrusions of the inorganic filler on the outermost layer satisfies the above-described formula (5), the adhesive force and the frictional force caused by the contact between the toner and the outermost layers of the photoreceptors 1Y, 1M, 1C, and 1Bk are reduced.

Thus, when the average distance between raised parts $R_2$ satisfies the above-described formula (5), even in a case where the amount of a lubricant supplied is small, the impact force of the residual toner that smashes against the blade 61 can be reduced. In addition, the residual toner can be surely and quickly removed from the outermost layer in cleaning. Further, escape of the residual toner, the above-described impact force, and liberation of the external additive by convection of the external additive are reduced. Accordingly, escape of excessive free external additives and its agglomerated materials, and escape of agglomerated materials of toners and free external additives are reduced. As a result, load in cleaning is reduced, and abrasion of the photoreceptors 1Y, 1M, 1C, and 1Bk and the blade 61 is reduced. Furthermore, cleaning characteristics are improved, and contamination with free external additives in the apparatus is prevented, resulting in reduced image defects.

The average distance between raised parts $R_2$ of the raised structures constituted by protrusions of the inorganic filler on the outermost layer is 250 nm or less (the above-described formula (7)). This is based on the following supposition. When the average distance between raised parts $R_2$ exceeds 250 inn, even when the average distance between raised parts $R_2$ is equal to or less than the maximum value of average distances between raised parts $R_2'$, the blade 61 and the resin part of the polymerized and cured product contained in the outermost layer tend to come into excessive contact with each other, and abrasion loss of the photoreceptors 1Y, 1M, 1C, and 1Bk may increase. This increase in abrasion loss facilitates escape of excessive free external additives and its agglomerated materials, escape of agglomerated materials of toners and free external additives, or the like. In addition, when toner easily comes into contact with the resin part of the polymerized and cured product, the adhesive force and the frictional force between the toner and the outermost layer increase, and the impact force of the residual toner that smashes against the blade 61 increases. Due to this increase in impact force, the liberation of the external additives is further facilitated, and thus escape of excessive free external additives and its agglomerated materials, escape of agglomerated materials of toners and free external additives, or the like more easily occur. Consequently, sufficient cleaning characteristics cannot be achieved, load in cleaning is increased, and more abrasion loss of the blade 61 occurs.

When printing speed is increased, the linear velocity becomes higher, resulting in a higher impact force of the residual toner smashing against the blade 61. Further, an abutting state of the blade 61 against the photoreceptors 1Y, 1M, 1C, and 1Bk tends to be unstable. Although the above-described effects of the image forming apparatus 100 can be exerted regardless of printing speed, the above-described effects of the image forming apparatus 100 becomes more remarkable at higher printing speed.

It should be noted that the above-described mechanism is based on a speculation, and the scope of the present invention is not affected by whether the mechanism is correct or not.

Specific configurations of the photoreceptors 1Y, 1M, 1C, and 1Bk are described below.

The photoreceptors 1Y, 1M, 1C, and 1Bk are bodies that retain a latent image or a manifest image thereon in an electrophotographic image formation. As described above, the photoreceptors 1Y, 1M, 1C, and 1Bk preferably each have an outermost layer. Constituents of the photoreceptors 1Y, 1M, 1C, and 1Bk except for the outermost layer have the same configurations of the photoreceptors described in, for example, JP 2012-078620 A other than the outermost layer. The outermost layers of the photoreceptors 1Y, 1M, 1C, and 1Bk may have the same configurations as those of the outermost layers described in JP 2012-078620 A, except that their materials are different from each other.

The configurations of the photoreceptors 1Y, 1M, 1C, and 1Bk are not particularly limited. The photoreceptors 1Y, 1M, 1C, and 1Bk each preferably include a conductive support, a photosensitive layer disposed on the conductive support, and a protective layer disposed on the photosensitive layer. For example, this protective layer is the outermost layer of each of the photoreceptors 1Y, 1M, 1C, and 1Bk. The photoreceptors 1Y, 1M, 1C, and 1Bk having the above-described configurations are described in detail below.

The conductive support supports the photosensitive layer. The conductive support has conductivity. The conductive support has, for example, a cylindrical shape. Examples of the conductive support include a metal drum, a metal sheet, a plastic film having metal foil laminated thereon, a plastic film having a film of a conductive substance deposited thereon, a metal member having a conductive layer, a plastic film having a conductive layer, or paper having a conductive layer. The conductive layer is formed by, for example, applying a paint containing a conductive substance onto a metal member or the like. The conductive layer may contain a binder resin together with a conductive substance. The metal contained in the conductive support is preferably, for example, aluminum, copper, chromium, nickel, zinc, and stainless steel. The conductive substance contained in the conductive layer is preferably, for example, the above-described metals, indium oxide, and tin oxide.

The photosensitive layer is a layer for forming an electrostatic latent image of an intended image on the surface of the photoreceptors 1Y, 1M, 1C, and 1Bk by exposure. The photosensitive layer may be a single layer, or may include a plurality of layers having a layered arrangement. Preferred examples of the photosensitive layer include a single layer containing a charge transporting material and a charge generating material, and a laminate of a charge transporting layer containing a charge transporting material and a charge generating layer containing a charge generating material.

The protective layer is a layer for improving mechanical strength of the surface of the photoreceptors 1Y, 1M, 1C, and 1Bk to improve scratch resistance or abrasion resistance. Preferred examples of the protective layer include a layer formed of a polymerized and cured product of a composition containing a polymerizable monomer.

The photoreceptors 1Y, 1M, 1C, and 1Bk may each further include constituents other than the conductive support, the photosensitive layer, and the protective layer described above. Preferred examples of the above-described other constituent include an intermediate layer. The intermediate layer is, for example, a layer that is disposed between the above-described conductive support and the above-described photosensitive layer and has a barrier function and an adhesive function. That is, the photoreceptors 1Y, 1M, 1C, and 1Bk may each include a conductive support, an intermediate layer disposed on the conductive support, a photosensitive layer disposed on the intermediate layer, and a protective layer disposed on the photosensitive layer.

The outermost layer of each of the photoreceptors 1Y, 1M, 1C, and 1Bk is a layer disposed on an outermost portion of the photoreceptor on a side with which a toner comes into contact. The outermost layer is preferably, but not particularly limited to, the above-described protective layer. For example, the photoreceptors 1Y, 1M, 1C, and 1Bk each have a multilayer configuration including a conductive support, a photosensitive layer, and a protective layer in this order, and the protective layer is disposed on an outermost portion of the photoreceptor on a side with which a toner comes into contact. The outermost layer is, for example, formed of a polymerized and cured product of a composition containing a polymerizable monomer and an inorganic filler (hereinafter, also referred to as a composition for outermost layer). Constituent elements of the outermost layer are described in detail below.

The composition for outermost layer contains an inorganic filler. Herein, the inorganic filler refers to a particle in which at least the surface thereof is formed of an inorganic material. The inorganic filler has a function of improving abrasion resistance of the outermost layer. In addition, the inorganic filler has a function of improving efficiency in removal of the residual toner to improve cleaning characteristics and reduce abrasion of the photoreceptors 1Y, 1M, 1C, and 1Bk and the blade 61.

Hereinafter, a surface treatment agent having a silicone chain is also referred to as a "silicone surface treatment agent", and a surface treatment with the "silicone surface treatment agent" is also simply referred to as a "silicone surface treatment". In addition, a surface treatment agent having a polymerizable group is also simply referred to as a "reactive surface treatment agent", and a surface treatment with the "reactive surface treatment agent" is also simply referred to as a "reactive surface treatment". Further, an inorganic filler subjected to at least one of the "silicone surface treatment" and the "reactive surface treatment" is sometimes also collectively referred to as "surface-treated particles".

The inorganic filler is not particularly limited, and preferably contains metal oxide particles. Herein, the metal oxide particle represents a particle in which at least the surface thereof (or the surface of an untreated metal oxide particle, which is an untreated base particle, when the particle is a surface-treated particle) is constituted by a metal oxide.

The shape of the particle may be, but is not particularly limited to, powdery, spherical, a rod shape, a needle shape, a plate shape, columnar, an indefinite shape, a scale shape, a spindle shape, or the like.

Examples of the metal oxide that constitutes the metal oxide particles include, but are not particularly limited to, silica (silicon oxide), magnesium oxide, zinc oxide, lead oxide, alumina (aluminum oxide), tin oxide ($SnO_2$), tantalum oxide, indium oxide, bismuth oxide, yttrium oxide, cobalt oxide, copper oxide, manganese oxide, selenium oxide, iron oxide, zirconium oxide, germanium oxide, tin oxide, titanium dioxide ($TiO_2$), niobium oxide, molybdenum oxide, vanadium oxide, copper aluminum oxide, and antimony-doped tin oxide ($SnO_2$—Sb). Among these, silica ($SiO_2$) particles, tin oxide particles, titanium dioxide particles, and antimony-doped tin oxide particles are preferred, and tin oxide particles are more preferred. These metal oxide particles may be used alone, or in combination of two or more.

The metal oxide particle is preferably a composite particle having a core-shell structure that includes a core material (core) and an outer shell (shell) including a metal oxide. In such a composite particle, since a core material (core) having a refractive index that is close to that of a polymerizable monomer can be selected, transmission of active energy rays (in particular, ultraviolet rays) used for curing the outermost layer can be increased. Thus, the strength of the surface of the cured outermost layer can be increased, and the abrasion of the outermost layer can be further reduced. In addition, materials that constitute the outer shell (shell) can be selected or the shape of the outer shell (shell) can be controlled so as to further increase a surface treatment effect in a surface-treated particle (described later). Accordingly, the effect of reducing abrasion of the photoreceptors 1Y, 1M, 1C, and 1Bk and the blade 61 and the effect of reducing image defects can be increased, and, in addition, the transfer properties to rough paper can be further improved. Examples of the material that constitutes the core material (core) of the composite particle are, but not particularly limited to, insulating materials such as barium sulfate ($BaSO_4$), alumina ($Al_2O_3$), and silica ($SiO_2$). Among these, from the viewpoint of ensuring optical transparency of the outermost layer, barium sulfate and silica are preferred. Materials that constitute the outer shell (shell) of the composite particle are the same as those described as metal oxides that constitute the metal oxide particles. Preferred examples of the composite particle having a core-shell structure include a composite particle having a core-shell structure that includes a core material including barium sulfate and an outer shell including tin oxide. The ratio of a number average primary particle size of the core material to the thickness of the outer shell can be appropriately determined depending on types of the core material and the outer shell, and a combination of the core material and the outer shell used in the composite particle such that a desired surface treatment effect can be obtained.

The lower limit of the number average primary particle size of the inorganic filler is preferably, but not particularly limited to, 1 nm or more, more preferably 5 nm or more, still more preferably 10 nm or more, even more preferably 50 nm or more, and particularly preferably 80 nm or more. When the number average primary particle size is equal to or more than the above-described lower limit, the cleaning characteristics are further improved, and the abrasion of the photoreceptors 1Y, 1M, 1C, and 1Bk is further reduced. On the other hand, the upper limit of the number average primary particle size of the inorganic filler is preferably, but not particularly limited to, 700 nm or less, more preferably 500 nm or less, still more preferably 300 nm or less, even more preferably 200 nm or less, and particularly preferably 150 nm or less. When the number average primary particle size is equal to or less than the above-described upper limit, the cleaning characteristics are further improved, and the abrasion of the blade 61 is further reduced. Speculated reasons of these effects are as follows. When the number average primary particle size is controlled within the above-described range, the average height of raised parts $R_1$ of the outermost layer and the average distance between raised parts $R_2$ of the raised structures constituted by protrusions of the inorganic filler on the outermost layer can be caused to fall within a preferred range. Thus, the number average primary particle size of the inorganic filler is preferably 80 nm or more and 200 nm or less. (Examples: 10, 20, and 100 nm) Herein, the number average primary particle size of the inorganic filler is measured as follows. An image of the outermost layer captured by a scanning electron microscope (manufactured by JEOL Ltd.) at a magnification of 10,000 is read with a scanner. From the photographic image obtained above, images of 300 particles excluding agglomerated particles are randomly converted into binarized images using an automatic image processing and analysis system LUZEX (registered trademark) AP with software version Ver. 1.32 (manufactured by NIRECO CORPORATION), and the horizontal Feret diameter of each particle image is calculated. Then, the average of the horizontal Feret diameters of the particle images is calculated and defined as a number average primary particle size. Here, the horizontal Feret diameter refers to the length of a side (parallel to the x axis) of a rectangle that circumscribes the above-described binarized particle image. In an inorganic filler having a polymerizable group or surface-treated particles (described later), the measurement of the number average primary particle size of the inorganic filler is performed on an inorganic filler (untreated base particle) that contains no chemical species having a polymerizable group or chemical species derived from a surface treatment agent (coating layer).

The inorganic filler in the composition for outermost layer preferably has a polymerizable group. When the inorganic filler in the composition for outermost layer has a polymerizable group, the abrasion of the photoreceptors 1Y, 1M, 1C, and 1Bk is further reduced. A speculated mechanism is as follows. In a cured product that forms the outermost layer, the inorganic filler having a polymerizable group and a polymerizable monomer are chemically bonded to each other, and the surface strength of the outermost layer is increased. The polymerizable group is preferably, but not particularly limited to a specific type, a radically polymerizable group. The polymerizable group is preferably introduced by, but not particularly limited to, a method in which an inorganic filler is subjected to a surface treatment with a surface treatment agent having a polymerizable group as described later.

The presence of a polymerizable group in the inorganic filler in the composition for outermost layer and the presence of a group derived from a polymerizable group in the inorganic filler in the outermost layer can be detected by, for example, thermogravimetry/differential thermal analysis (TG/DTA), observation using a scanning electron microscope (SEM) or a transmission electron microscope (TEM), and analysis using energy dispersive X-ray spectroscopy (EDX).

A preferred content of the inorganic filler in the composition for outermost layer will be described in the description of a method of producing photoreceptors 1Y, 1M, 1C, and 1Bk given below.

Surface Treatment with Surface Treatment Agent Having Silicone Chain (Silicone Surface Treatment Agent) The inorganic filler is preferably subjected to a surface treatment (silicone surface treatment) with a surface treatment agent having a silicone chain (silicone surface treatment agent).

The silicone surface treatment agent preferably has a structural unit represented by the following chemical formula (1):

Chemical Formula (1)

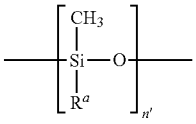

In chemical formula (1), Ra represents a hydrogen atom or a methyl group, and n' is an integer of 3 or more.

The silicone surface treatment agent may be a silicone surface treatment agent having a silicone chain in the main chain (main chain type silicone treatment agent) or a silicone surface treatment agent having a silicone chain in a side chain (side chain type silicone treatment agent), with the side chain type silicone treatment agent being preferred. That is, the inorganic filler is preferably subjected to a surface treatment with a side chain type silicone surface treatment agent. The side chain type silicone treatment agent further reduces the adhesive force and the frictional force between an external additive and an inorganic filler, and further improve the efficiency in removal of the residual toner. Accordingly, the cleaning characteristics can be further improved, and, in particular, the abrasion of the blade 61 can be further reduced. A speculated reason is as follows. The side chain type silicone surface treatment agent has a bulky structure, and can further increase the density of the silicone chains on the inorganic filler, resulting in a higher hydrophobicity of the surface of the metal oxide particles with efficiency. As a result, the adhesive force and the frictional force between the external additive and the inorganic filler can be remarkably reduced.

The side chain type silicone surface treatment agent is preferably, but not particularly limited to, an agent having a silicone chain in a side chain of a high molecular weight main chain and further having a surface treating functional group. Examples of the surface treating functional group include a group that is capable of binding to a conductive metal oxide particle, such as a carboxylic acid group, a hydroxy group, —Rd-COOH (Rd is a divalent hydrocarbon group), a halogenated silyl group, and an alkoxy silyl group. Among these, a carboxylic acid group, a hydroxy group, or an alkoxy silyl group is preferred, and a hydroxy group or an alkoxy silyl group is more preferred.

The side chain type silicone surface treatment agent preferably has, from the viewpoint of further reducing the abrasion of the blade 61 while maintaining the above-described effect, a poly(meth)acrylate main chain or a silicone main chain as a high molecular weight main chain.

The silicone chain of the side chain and the main chain preferably has a dimethylsiloxane structure as a repeating unit. The silicone chain preferably has 3 to 100 repeating units, more preferably has 3 to 50 repeating units, and still more preferably 3 to 30 repeating units.

The weight average molecular weight of the silicone surface treatment agent is preferably, but not particularly limited to, 1,000 or more and 50,000 or less. The weight average molecular weight of the silicone surface treatment agent can be measured by gel permeation chromatography (GPC).

The silicone surface treatment agent may be a synthetic product or a commercially available product. Specific examples of the commercially available main chain type silicone surface treatment agent include KF-99 and KF-9901 (manufactured by Shin-Etsu Chemical Co., Ltd.). Specific examples of the commercially available side chain type silicone surface treatment agent having a silicone chain in a side chain of a poly(meth)acrylate main chain include SYMAC (registered trademark) US-350 (manufactured by Toagosei Co., Ltd.); and KP-541, KP-574, and KP-578 (manufactured by Shin-Etsu Chemical Co., Ltd.). Examples of the commercially available side chain type silicone surface treatment agent having a silicone chain in a side chain of the silicone main chain include KF-9908 and KF-9909 (manufactured by Shin-Etsu Chemical Co., Ltd.). The silicone surface treatment agents may be used alone, or in combination of two or more.

The surface treatment method with a silicone surface treatment agent is not particularly limited as long as the method can attach (or join) the silicone surface treatment agent onto the surface of the inorganic filler. Examples of the above-described surface treatment method fall into two main groups including a wet processing method and a dry processing method, and either of the methods can be used.

When a reactive surface treated inorganic filler (described later) is subjected to a silicone surface treatment, in the surface treatment with a silicone surface treatment agent, it is sufficient that the silicone surface treatment agent can be attached (or joined) onto the surface of the inorganic filler or onto the reactive surface treatment agent.

The wet processing method refers to a method of dispersing an inorganic filler and a silicone surface treatment agent in a solvent to attach (or join) the silicone surface treatment agent onto the surface of the inorganic filler. In the method, it is preferred that an inorganic filler and a silicone surface treatment agent are dispersed in a solvent, and thereafter the resulting dispersion is dried to remove the solvent. In the method, it is more preferred that, after the above-described step, a heat treatment is performed to cause a reaction of the silicone surface treatment agent and the inorganic filler, and thereby attach (or join) the silicone surface treatment agent onto the surface of the inorganic filler. Alternatively, the silicone surface treatment agent and the inorganic filler may be dispersed in a solvent, and the resulting dispersion may be subjected to wet grinding to micronize the inorganic filler while a surface treatment is carried out.

The inorganic filler and the silicone surface treatment agent can be dispersed in a solvent using publicly known devices, and examples of the device include, but are not particularly limited to, common dispersing units such as a homogenizer, a ball mill, and a sand mill.

The solvent is not particularly limited, and publicly known solvents can be used. Examples of the solvent include alcohol solvents and aromatic hydrocarbon solvents. Examples of the alcohol solvents include methanol, ethanol, n-propanol, isopropanol, n-butanol, sec-butanol (2-butanol), tert-butanol, and benzyl alcohol. Examples of the aromatic hydrocarbon solvents include toluene and xylene. These solvents can be used alone, or in combination of two or more. Among these, methanol, 2-butanol, toluene, and a mixed solvent of 2-butanol and toluene are more preferred, with 2-butanol being still more preferred.

The dispersing time is preferably, but not particularly limited to, for example, 1 minute or more and 600 minutes or less, more preferably 10 minutes or more and 360 minutes or less, and still more preferably 30 minutes or more and 120 minutes or less.

The method for removing the solvent is not particularly limited, and publicly known methods can be used. Examples of the method include a method using an evaporator, and a method of evaporating the solvent at room temperature. Among these, the method of evaporating the solvent at room temperature is preferred.

The heating temperature is preferably, but not particularly limited to, 50° C. or higher and 250° C. or lower, more preferably 70° C. or higher and 200° C. or lower, and still more preferably 80° C. or higher and 150° C. or lower. The heating time is preferably, but not particularly limited to, 1 minute or more and 600 minutes or less, more preferably 10 minutes or more and 300 minutes or less, and still more preferably 30 minutes or more and 90 minutes or less. The heating method is not particularly limited, and publicly known methods can be used.

The dry processing method is a method in which no solvent is used, and a silicone surface treatment agent and an inorganic filler are mixed and kneaded to attach (or join) the silicone surface treatment agent onto the surface of the inorganic filler. The method may be a method in which a silicone surface treatment agent and an inorganic filler are mixed and kneaded, and thereafter the mixture is subjected to a heat treatment to cause a reaction of the silicone surface treatment agent and the inorganic filler, and thereby attach (or join) the silicone surface treatment agent onto the surface of the inorganic filler. Further, when the inorganic filler and the silicone surface treatment agent are mixed and kneaded, the mixture may be subjected to dry grinding to micronize the inorganic filler and concurrently carry out the surface treatment.

The amount of the silicone surface treatment agent used in the silicone surface treatment is preferably 0.1 parts by mass or more, more preferably 1 part by mass or more, and still more preferably 2 parts by mass or more relative to 100 parts by mass of the inorganic filler (or a reactive surface treated inorganic filler when a reactive surface treated inorganic filler (described later) is subjected to the silicone surface treatment) before the silicone surface treatment. When the amount is equal to or more than the above-described lower limit, the cleaning characteristics are further improved, and the abrasion of the blade 61 is further reduced. On the other hand, the amount of the silicone surface treatment agent used in the silicone surface treatment is preferably 100 parts by mass or less, more preferably 10 parts by mass or less, and still more preferably 5 parts by mass or less relative to 100 parts by mass of the inorganic filler (or a reactive surface treated inorganic filler when a reactive surface treated inorganic filler (described later) is subjected to the silicone surface treatment) before the silicone surface treatment. When the amount is equal to or less than the above-described upper limit, decrease in the strength of the surface of the outermost layer due to unreacted silicone surface treatment agents can be reduced, and the abrasion of the photoreceptors 1Y, 1M, 1C, and 1Bk is further reduced.

Whether the untreated inorganic filler or a reactive surface treated inorganic filler is subjected to the silicone surface treatment or not can be determined by, for example, thermogravimetry/differential thermal analysis (TG/DTA), observation using a scanning electron microscope (SEM) or a transmission electron microscope (TEM), and analysis using energy dispersive X-ray spectroscopy (EDX).

Surface Treatment Method with Surface Treatment Agent Having Polymerizable Group (Reactive Surface Treatment Agent) As described above, the inorganic filler in the composition for outermost layer preferably has a polymerizable group. The polymerizable group is preferably introduced by, but not limited to, a method in which a reactive surface treatment is performed.

That is, the inorganic filler is preferably subjected to a surface treatment (reactive surface treatment) with a surface treatment agent having a polymerizable group (reactive surface treatment agent). After the reactive surface treatment, the polymerizable group is retained on the surface of a conductive metal oxide particle, and thus the inorganic filler has the polymerizable group. In other words, the inorganic filler preferably has a group that is derived from the polymerizable group.

The reactive surface treatment agent has a polymerizable group and a surface treating functional group. The polymerizable group is preferably, but not particularly limited to a specific type, a radically polymerizable group. Here, the radically polymerizable group refers to a group that is capable of radical polymerization and has a carbon-carbon double bond. Examples of the radically polymerizable group include a vinyl group and a (meth)acryloyl group. Among these, a methacryloyl group is preferred. The surface treating functional group refers to a group that has a reactivity with a polar group, such as a hydroxy group, present on the surface of a conductive metal oxide particle. Examples of the surface treating functional group include a carboxylic acid group, a hydroxy group, —R'—COOH (R' is a divalent hydrocarbon group), a halogenated silyl group, and an alkoxy silyl group. Among these, a halogenated silyl group and an alkoxy silyl group are preferred.

The reactive surface treatment agent is preferably a silane coupling agent having a radically polymerizable group.

Examples of the reactive surface treatment agent include the following compounds represented by chemical formulae S-1 to S-33:

[Chemical Formula 2]

S-1 $CH_2{=}CHSi(CH_3)(OCH_3)_2$

S-2 $CH_2{=}CHSi(OCH_3)_3$

S-3 $CH_2{=}CHSiCl_3$

S-4 $CH_2{=}CHCOO(CH_2)_2Si(CH_3)(OCH_3)_2$

S-5 $CH_2{=}CHCOO(CH_2)_2Si(OCH_3)_3$

S-6 $CH_2{=}CHCOO(CH_2)_2Si(OC_2H_5)(OCH_3)_2$

S-7 $CH_2{=}CHCOO(CH_2)_3Si(OCH_3)_3$

S-8 $CH_2{=}CHCOO(CH_2)_2Si(CH_3)Cl_2$

S-9 $CH_2{=}CHCOO(CH_2)_2SiCl_3$

S-10 $CH_2{=}CHCOO(CH_2)_3Si(CH_3)Cl_2$

S-11 $CH_2{=}CHCOO(CH_2)_3SiCl_3$

S-12 $CH_2{=}C(CH_3)COO(CH_2)_2Si(CH_3)(OCH_3)_2$

S-13 $CH_2{=}C(CH_3)COO(CH_2)_2Si(OCH_3)_3$

S-14 $CH_2{=}C(CH_3)COO(CH_2)_3Si(CH_3)(OCH_3)_2$

S-15 $CH_2{=}C(CH_3)COO(CH_2)_3Si(OCH_3)_3$

S-16 $CH_2{=}C(CH_3)COO(CH_2)_2Si(CH_3)Cl_2$

S-17 $CH_2{=}C(CH_3)COO(CH_2)_2SiCl_3$

S-18 $CH_2{=}C(CH_3)COO(CH_2)_3Si(CH_3)Cl_2$

S-19 $CH_2{=}C(CH_3)COO(CH_2)_3SiCl_3$

S-20 $CH_2{=}CHSi(C_2H_5)(OCH_3)_2$

S-21 $CH_2{=}C(CH_3)Si(OCH_3)_3$

S-22 $CH_2{=}C(CH_3)Si(OC_2H_5)_3$

S-23 $CH_2{=}CHSi(OCH_3)_3$

S-24 $CH_2{=}C(CH_3)Si(CH_3)(OCH_3)_2$

S-25 $CH_2{=}CHSi(CH_3)Cl_2$

S-26 $CH_2{=}CHCOOSi(OCH_3)_3$

S-27 $CH_2{=}CHCOOSi(OC_2H_5)_3$

S-28 $CH_2{=}C(CH_3)COOSi(OCH_3)_3$

S-29 $CH_2{=}C(CH_3)COOSi(OC_2H_5)_3$

S-30 $CH_2{=}C(CH_3)COO(CH_2)_3Si(OC_2H_5)_3$

S-31 $CH_2{=}CHCOO(CH_2)_2Si(CH_3)_2(OCH_3)$

S-32 $CH_2{=}C(CH_3)COO(CH_2)_8Si(OCH_3)_3$

-continued

S-33

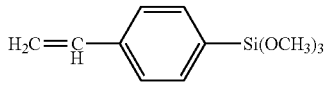

The reactive surface treatment agent may be a synthetic product or a commercially available product. Specific examples of the commercially available product include KBM-502, KBM-503, KBE-502, KBE-503, and KBM-5103 (manufactured by Shin-Etsu Chemical Co., Ltd.). The reactive surface treatment agents may be used alone, or in combination of two or more.

When both the silicone surface treatment and the reactive surface treatment are performed, it is preferred that the reactive surface treatment is performed, and then the silicone surface treatment is performed. When the surface treatments are performed in this order, the abrasion resistance of the outermost layer is further improved. This is because since prevention of the contact between the reactive surface treatment agent and the surface of the inorganic filler by a silicone chain having oil-repellency does not occur, polymerizable groups are efficiently introduced to the inorganic filler.

The method of the reactive surface treatment is not particularly limited, and the same methods as those described in the silicone surface treatment can be used except that a reactive surface treatment agent is used instead. Also, publicly known techniques for surface treatment of metal oxide particles can be used.

Here, when the wet processing method is used, solvents that are the same as those described in the silicone surface treatment can be preferably used, and methanol, toluene, a mixed solvent of methanol and toluene are more preferred, with a mixed solvent of methanol and toluene being still more preferred.

Examples of the method for removing the solvent include methods that are the same as those described in the silicone surface treatment. Among these, the method using an evaporator is preferred.

The amount of the reactive surface treatment agent used in the surface treatment is preferably 0.5 parts by mass or more, more preferably 1 part by mass or more, and still more preferably 1.5 parts by mass or more relative to 100 parts by mass of the inorganic filler (or the silicone surface treated inorganic filler when the silicone surface treated inorganic filler described above is subjected to the reactive surface treatment) before the reactive surface treatment. When the amount is equal to or more than the above-described lower limit, the strength of the surface of the outermost layer is increased, and the abrasion of the photoreceptors 1Y, 1M, 1C, and 1Bk is further reduced. On the other hand, the amount of the reactive surface treatment agent used in the surface treatment is preferably 15 parts by mass or less, more preferably 10 parts by mass or less, and still more preferably 8 parts by mass or less relative to 100 parts by mass of the inorganic filler (or the silicone surface treated inorganic filler when the silicone surface treated inorganic filler described above is subjected to the reactive surface treatment) before the reactive surface treatment. When the amount is equal to or less than the above-described upper limit, the amount of the reactive surface treatment agent relative to the number of hydroxy groups on the surface of the particle is not excessive and falls within a more preferred range, decrease in the strength of the surface of the outermost layer due to unreacted reactive surface treatment agents can be reduced to increase the strength of the surface of the outermost layer, and the abrasion of the photoreceptors 1Y, 1M, 1C, and 1Bk is further reduced.

The composition for outermost layer includes a polymerizable monomer. Herein, the polymerizable monomer refers to a compound that has a polymerizable group and can be polymerized (cured) by irradiation with active energy rays such as ultraviolet rays, visible light, and electron rays, or by application of energy such as heating to form a binder resin of the outermost layer. Herein, the polymerizable monomer does not include the above-described reactive surface treatment agent. In addition, when a polymerizable silicone compound or a polymerizable perfluoropolyether compound as a lubricating agent (described later) is used, the polymerizable monomer does not include these compounds.

The polymerizable group included in the polymerizable monomer is preferably, but not particularly limited to a specific type, a radically polymerizable group. Here, the radically polymerizable group refers to a group that is capable of radical polymerization and has a carbon-carbon double bond. Examples of the radically polymerizable group include a vinyl group and a (meth)acryloyl group, with a (meth)acryloyl group being preferred. When the polymerizable group is a (meth)acryloyl group, abrasion resistance of the outermost layer is increased, and the abrasion of the photoreceptors 1Y, 1M, 1C, and 1Bk is further reduced. A speculated reason for this increase in abrasion resistance of the outermost layer is that efficient curing by a small amount of light or within a short period of time becomes possible.

Examples of the polymerizable monomer include styrene monomers, (meth)acrylic monomers, vinyltoluene monomers, vinyl acetate monomers, and N-vinylpyrrolidone monomers. These monomers may be used alone, or in combination of two or more.

The number of the polymerizable groups included in the polymerizable monomer per molecule is preferably, but not particularly limited to, 2 or more, and more preferably 3 or more. When the number is equal to or more than the lower limit, abrasion resistance of the outermost layer is increased, and the abrasion of the photoreceptors 1Y, 1M, 1C, and 1Bk is further reduced. A speculated reason for this is that cross linking density in the outermost layer is increased, and the strength of the surface of the outermost layer is further increased. On the other hand, the number of the polymerizable groups included in the polymerizable monomer per molecule is preferably, but not particularly limited to, 6 or less, more preferably 5 or less, and still more preferably 4 or less. When the number is equal to or more than the upper limit, the outermost layer becomes more uniform. A speculated reason for this is that the cross linking density becomes a certain level or less, and cure shrinkage rarely occurs. From these viewpoints, the number of polymerizable groups included in the polymerizable monomer per molecule is most preferably 3.

Specific examples of the polymerizable monomer include, but are not limited to, the following compounds M1 to M11. Among these, the following compound M2 is particularly preferred. In each of the following chemical formulae, R represents an acryloyl group ($CH_2{=}CHCO{-}$), and R' represents a methacryloyl group ($CH_2{=}C(CH_3)CO{-}$).

M1

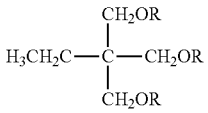

-continued

M2

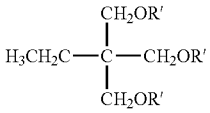

M3

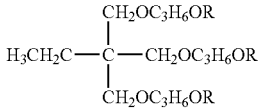

M4

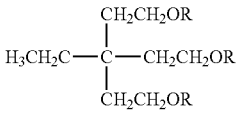

M5

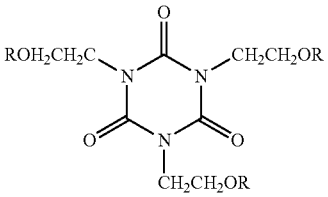

M6

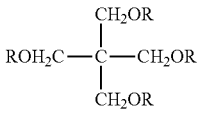

M7

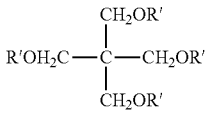

M8

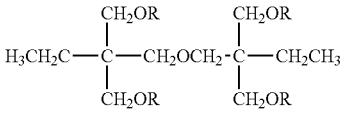

M9

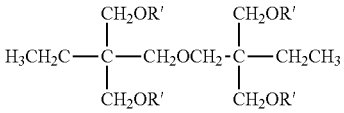

M10

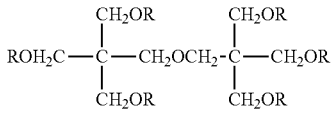

M11

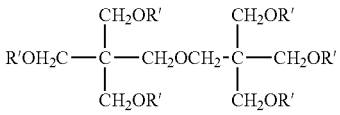

The polymerizable monomer may be a synthetic product or a commercially available product. The polymerizable monomers may be used alone, or in combination of two or more. A preferred content of the polymerizable monomers in the composition for outermost layer will be described in the description of a method of producing photoreceptors 1Y, 1M, 1C, and 1Bk given below.

The composition for outermost layer preferably further contains a polymerization initiator. The polymerization initiator is used in a process for producing a cured resin (binder resin) that is obtained by polymerization of the above-described polymerizable monomers. The polymerization initiator may be a thermal polymerization initiator or a photopolymerization initiator, with a photopolymerization initiator being preferred. When the polymerizable monomer is a radically polymerizable monomer, a radical polymerization initiator is preferred. The radical polymerization initiator is not particularly limited, and publicly known radical polymerization initiators can be used. Examples of the initiator include alkylphenone compounds and phosphine oxide compounds. Among these, a compound having an α-aminoalkylphenone structure or an acylphosphine oxide structure is preferred, and a compound having an acylphosphine oxide structure is more preferred. An example of the compound having an acylphosphine oxide structure is IRGACURE (registered trademark) 819 (bis(2,4,6-trimethylbenzoyl)phenylphosphine oxide) (manufactured by BASF Japan Ltd.). The polymerization initiators may be used alone, or in combination of two or more. A preferred content of the polymerization initiator in the composition for outermost layer will be described in the description of a method of producing photoreceptors 1Y, 1M, 1C, and 1Bk given below.

The composition for outermost layer may further contain other components that are different from the above-described components. The above-described other component is not particularly limited. When the outermost layer is a protective layer, examples include a lubricating agent. The charge transporting material is not particularly limited, and publicly known charge transporting materials can be used. Examples of the charge transporting material include triarylamine derivatives. The lubricating agent is not particularly limited, and publicly known lubricating agents can be used. Examples of the lubricating agent include a polymerizable silicone compound and a polymerizable perfluoropolyether compound.

The surface of the outermost layer has raised structures constituted by protrusions of the inorganic filler. Herein, the term a "raised structure constituted by protrusions of an inorganic filler" refers to a raised structure composed of an exposed inorganic filler.

Whether the raised structure that is present on the surface of the outermost layer is constituted by protrusions of an inorganic filler or not can be determined by, for example, visual observation of a photographic image of the surface of the outermost layer captured using a scanning electron microscope (SEM) "JSM-7401F" (manufactured by JEOL Ltd.).

The average height of raised parts $R_1$ of the outermost layer is preferably, but not particularly limited to, 1 nm or more, more preferably 15 nm or more, still more preferably 25 nm or more. When the average height is equal to or more than the above-described lower limit, the cleaning characteristics are further improved, and the abrasion of the photoreceptors 1Y, 1M, 1C, and 1Bk is further reduced. A speculated reason for this is that when the average height of raised parts $R_1$ of the outermost layer becomes higher, the abrasion of the outermost layer by the blade 61 is further reduced, and possibility of contact between a toner and the outermost layer caused by contact between the external additive and the inorganic filler is further increased. On the other hand, the average height of raised parts $R_1$ of the outermost layer is preferably, but not particularly limited to, 100 nm or less, more preferably 55 nm or less, and still more preferably 35 nm or less (lower limit: 0 nm). When the average height is within the above-described range, the cleaning characteristics are further improved, and the abrasion of the blade 61 is further reduced. A speculated reason for this is that the abrasion of the blade 61 by the inorganic filler in the outermost layer is further reduced, and the blade 61 and the resin part of the polymerized and cured product that forms the outermost layer are sufficiently in contact with each other.

The average height of raised parts $R_1$ of the outermost layer can be calculated as follows. The surface of the outermost layer is subjected to 3D measurement using a surface roughness analysis 3D scanning electron microscope "ERA-600FE" (manufactured by ELIONIX INC.), the average height of contour curve elements is calculated in 3D analysis, and the resulting average height is defined as the average height of raised parts $R_1$ of the outermost layer.

The average distance between raised parts $R_2$ of the raised structures constituted by protrusions of the inorganic filler on the outermost layer is equal to or less than the maximum value of average distances between raised parts $R_2'$ of the raised structures constituted by protrusions of the inorganic filler on the outermost layer that is calculated from the relationship between $R_1$ and $R_3$, and, as described above, 250 nm or less (lower limit: 0 n). When the average distance between raised parts $R_2$ of the raised structures constituted by protrusions of the inorganic filler on the outermost layer exceeds 250 nm, cleaning characteristics become insufficient, and abrasion losses of the photoreceptors 1Y, 1M, 1C, and 1Bk and the blade 61 become excessive. In addition, transfer properties to rough paper become insufficient. On the other hand, the average distance between raised parts $R_2$ of the raised structures constituted by protrusions of the inorganic filler on the outermost layer is preferably 240 nm or less, more preferably 225 nm or less, still more preferably 200 nm or less, and particularly preferably 150 nm or less. When the average distance is equal to or less than the above-described upper limit, the cleaning characteristics are further improved, and the abrasion of the blade 61 is further reduced. A speculated reason for this is that a toner easily comes into contact with the inorganic filler in the outermost layer, and thus the adhesive force and the frictional force between the toner and the outermost layer become smaller, and load in cleaning is reduced. In addition, the average distance between raised parts $R_2$ of the raised structures constituted by protrusions of the inorganic filler on the outermost layer is not particularly limited as long as the average distance is more than 0 nm, but, from the viewpoint of productivity, the average distance is preferably 120 nm or more.

The average distance between raised parts $R_2$ of the raised structures constituted by protrusions of the inorganic filler on the outermost layer is calculated as follows. First, a photographic image of the surface of the outermost layer captured using a scanning electron microscope (SEM) ("JSM-7401F", manufactured by JEOL Ltd.) is read with a scanner, parts of the inorganic filler in the photographic image are binarized with an image processing and analysis device ("LUZEX AP", manufactured by NIRECO CORPORATION), and the distance between two inorganic fillers is calculated. This calculation is repeated, and 50 distances between different pairs of inorganic fillers are obtained. Then, the average distance is calculated, and this average distance is defined as the average distance between raised parts $R_2$ of the raised structures constituted by protrusions of the inorganic filler on the outermost layer.

Here, each of the average height of raised parts $R_1$ of the outermost layer and the average distance between raised parts $R_2$ of the raised structures constituted by protrusions of the inorganic filler on the outermost layer can be controlled by, for example, the type and content of the inorganic filler, the type and content of the polymerizable monomer; and the presence or absence of a surface treatment, the type of surface treatment agent, conditions of the surface treatment; and the type of untreated base particle.

(Thickness of Outermost Layer)

The thickness of the outermost layer is not particularly limited, and a preferred thickness of the outermost layer can be appropriately determined depending on the types of the photoreceptors 1Y, 1M, 1C, and 1Bk, and the thickness is preferably, for example, 0.2 μm or more and 15 μm or less, and more preferably 0.5 μm or more and 10 μm or less.

(Method of Producing a Photoreceptor)

The photoreceptors 1Y, 1M, 1C, and 1Bk can be produced by publicly known methods, and the methods of producing the photoreceptors are not particularly limited, provided that a coating liquid for outermost layer (described later) is used. Among these, the photoreceptors are preferably produced by a method including a step of applying a coating liquid for outermost layer onto the surface of a photosensitive layer formed on a conductive support, and a step of irradiating the applied coating liquid for outermost layer with active energy rays or heating the applied coating liquid for outermost layer to polymerize a polymerizable monomer in the coating liquid for outermost layer, and more preferably produced by a method including a step of applying a coating liquid for outermost layer, and a step of irradiating the applied coating liquid for outermost layer with active energy rays to polymerize a polymerizable monomer in the coating liquid for outermost layer.

The coating liquid for outermost layer contains a polymerizable monomer and a composition for outermost layer including an inorganic filler. The composition for outermost layer preferably further contains a polymerization initiator, and may further contain other components that are different from the above-described components. Further, the coating liquid for outermost layer preferably contains a composition for outermost layer and a dispersion medium. Herein, a compound that is used only as a dispersion medium is excluded from the composition for outermost layer.

The dispersion medium is not particularly limited, and publicly known dispersion media can be used. Examples of the dispersion medium include methanol, ethanol, n-propyl alcohol, isopropyl alcohol, n-butanol, tert-butanol, 2-butanol (sec-butanol), benzyl alcohol, toluene, xylene, methyl ethyl ketone, cyclohexane, ethyl acetate, butyl acetate, methyl cellosolve, ethyl cellosolve, tetrahydrofuran, 1,3-dioxane, 1,3-dioxolane, pyridine, and diethylamine. The dispersion media may be used alone, or in combination of two or more.

The content of the dispersion medium is preferably, but not particularly limited to, 1 mass % or more and 99 mass % or less, more preferably 40 mass % or more and 90 mass % or less, and still more preferably 50 mass % or more and 80 mass % or less relative to the total mass of the coating liquid for outermost layer.

The content of the inorganic filler in the composition for outermost layer is preferably, but not particularly limited to, 20 mass % or more, more preferably 30 mass % or more, and still more preferably 40 mass % or more relative to the total mass of the composition for outermost layer. When the content is equal to or more than the above-described lower limit, abrasion resistance of the outermost layer is improved, and the abrasion of the photoreceptors 1Y, 1M, 1C, and 1Bk is further reduced. Further, as the content of the inorganic filler increases, the effects owing to the particle are increased, cleaning characteristics are improved, and the abrasion of the blade 61 is further reduced. On the other hand, content of the inorganic filler in the composition for outermost layer is preferably, but not particularly limited to, 90 mass % or less, more preferably 80 mass % or less, and still more preferably 70 mass % or less relative to the total mass of the composition for outermost layer. When the content is equal to or less than the above-described upper limit, since the content of the polymerizable monomer in the composition for outermost layer is relatively high, cross linking density in the outermost layer is increased, abrasion resistance is improved, and the abrasion of the photoreceptors 1Y, 1M, 1C, and 1Bk is further reduced. Further, the contact between the blade 61 and the resin part of the polymerized and cured product that forms the outermost layer becomes sufficient, and cleaning characteristics are improved. Furthermore, as a result, the abrasion of the blade 61 is further reduced.

The mass ratio of the polymerizable monomer to the inorganic filler in the composition for outermost layer (mass of polymerizable monomer/mass of inorganic filler in composition for outermost layer) is preferably, but not particularly limited to, 0.1 or more, more preferably 0.2 or more, and still more preferably 0.4 or more. When the mass ratio is equal to or more than the above-described lower limit, since the content of the polymerizable monomer in the composition for outermost layer is relatively high, cross linking density in the outermost layer is increased, abrasion resistance is improved, and the depletion of the photoreceptors 1Y, 1M, 1C, and 1Bk is further reduced. Further, the contact between the blade 61 and the resin part of the polymerized and cured product that forms the outermost layer becomes sufficient, and cleaning characteristics are improved. Furthermore, as a result, the abrasion of the blade 61 is further reduced. On the other hand, the mass ratio of the polymerizable monomer to the inorganic filler in the composition for outermost layer is preferably, but not particularly limited to, 10 or less, more preferably 2 or less, and still more preferably 1.5 or less. When the mass ratio is equal to or less than the above-described upper limit, abrasion resistance of the outermost layer is increased, and the depletion of the photoreceptors 1Y, 1M, 1C, and 1Bk is further reduced. Further, as the content of the inorganic filler increases, the effects owing to the particle are increased, cleaning characteristics are improved, and the abrasion of the blade 61 is further reduced.

When a polymerization initiator is contained in the composition for outermost layer, the content of the polymerization initiator is preferably, but not particularly limited to, 0.1 parts by mass or more, more preferably 1 part by mass or more, and still more preferably 5 parts by mass or more relative to 100 parts by mass of the polymerizable monomer. On the other hand, the content of the polymerization initiator in the composition for outermost layer is preferably, but not limited to, 30 parts by mass or less, and more preferably 20 parts by mass or less relative to 100 parts by mass of the polymerizable monomer. When the content is within the above-described range, cross linking density in the outermost layer is increased, abrasion resistance of the outermost layer is improved, and the abrasion of the photoreceptors 1Y, 1M, 1C, and 1Bk is further reduced.

The contents (mass %) of the inorganic filler, the cured product of a polymerizable monomer, and the optional polymerization initiator and other components (when each of the above components is polymerizable, each component includes a cured product thereof) relative to the total mass of the outermost layer are almost the same as the contents (mass %) of the inorganic filler, the polymerizable monomer, and the optional polymerization initiator and other components (when each of the above components is polymerizable, each component includes a cured product thereof) relative to the total mass of the composition for outermost layer, respectively.

The method for preparing the coating liquid for outermost layer is not particularly limited, and coating liquid can be prepared by adding the polymerizable monomer, the inorganic filler, and the optional polymerization initiator and other components to a dispersion medium, and stirring and mixing the resulting mixture until the components are dissolved or dispersed.

The outermost layer can be formed by applying the coating liquid for outermost layer prepared by the above-described method onto the photosensitive layer, and thereafter drying and curing the applied coating liquid.

In the above-described applying, drying, and curing processes, a reaction between the polymerizable monomers, a reaction between the inorganic fillers, and, when the inorganic filler has a polymerizable group, a reaction between the polymerizable monomer and the inorganic filler proceed to form the outermost layer containing a cured product of the composition for outermost layer.

The method for applying the coating liquid for outermost layer is not particularly limited, and the coating liquid can be applied by publicly known methods such as dip coating, spray coating, spinner coating, bead coating, blade coating, beam coating, a slide hopper coating method, and a circular slide hopper coating method, for example.

After the application of the above-described coating liquid, it is preferred that natural drying or thermal drying is performed to form a coating film, and the coating film is cured by irradiation with active energy rays. Preferred active energy rays include ultraviolet rays and electron rays, with ultraviolet rays being more preferred.

Any ultraviolet light source can be used as long as the light source emits ultraviolet rays. Examples of the light source used as the ultraviolet light source include low-pressure mercury lamps, middle-pressure mercury lamps, high-pressure mercury lamps, ultrahigh-pressure mercury lamps, carbon-arc lamps, a metal halide lamp, xenon lamps, and flush (pulse) xenon lamps. Irradiation conditions vary depending on the type of the lamps. The radiant dose (integrated light intensity) of ultraviolet rays is preferably 5 to 5000 $mJ/cm^2$, and more preferably 10 to 2000 $mJ/cm^2$. The illuminance of ultraviolet rays is preferably 5 to 500 $mW/cm^2$, and more preferably 10 to 100 $mW/cm^2$.

The irradiation period for achieving a necessary radiant dose (integrated light intensity) of active energy rays is preferably 0.1 seconds to 10 minutes, and, from the viewpoint of operation efficiency, more preferably 0.1 seconds to 5 minutes.

In the process of forming the outermost layer, the outermost layer may be dried before or after the irradiation with active energy rays, or during the irradiation with active energy rays, and any combination of these timings can be used for drying.

The drying conditions may be appropriately determined depending on the type of solvent, the film thickness, or the like. The drying temperature is preferably, but not particularly limited to, 20 to 180° C., and more preferably 80 to 140° C. The drying period is preferably, but not particularly limited to, 1 to 200 minutes, and more preferably 5 to 100 minutes.

In the outermost layer, the polymerizable monomer constitutes a polymer (polymerized and cured product). When the inorganic filler has a polymerizable group, in the outermost layer, the polymerizable monomer and the inorganic filler having the polymerizable group constitute a combined polymer (polymerized and cured product) that forms the outermost layer. Whether the polymerized and cured product is a polymer (polymerized and cured product) of the polymerizable monomer, or a polymer (polymerized and cured product) of the polymerizable monomer and the inorganic filler having a polymerizable group or not can be determined by analyzing the above-described polymer (polymerized and cured product) using publicly known instrumental analysis technique such as pyrolysis-GC-MS, nuclear magnetic resonance (NMR), a Fourier transform infrared spectrophotometer (FT-IR), or elemental analysis.

(Electrophotographic Image Forming Method)

For example, the image forming apparatus 100 forms an image on a sheet P as follows.

First, the surfaces of the photoreceptors 1Y, 1M, 1C, and 1Bk are negatively charged by chargers 2Y, 2M, 2C, and 2Bk (charging step) Next, the surfaces of the photoreceptors 1Y, 1M, 1C, and 1Bk are exposed according to image signals with exposurers 3Y, 3M, 3C, and 3Bk to form electrostatic latent images (exposing step). Thereafter, the above-described toners are provided on the surfaces of the photoreceptors 1Y, 1M, 1C, and 1Bk with developers 4Y, 4M, 4C, and 4Bk to develop the above-described electrostatic latent images (exposing step) into toner images (developing step).

Next, with first transferring rollers 5Y, 5M, 5C, and 5Bk, the toner images having corresponding colors formed on the photoreceptors 1Y, 1M, 1C, and 1Bk are sequentially transferred onto the rotating intermediate transfer body 70 (first transfer, transfer step) to form a color image on the intermediate transfer body 70.

Then, if necessary, after the first transferring rollers 5Y, 5M, 5C, and 5Bk and the intermediate transfer body 70 are separated, a lubricant 122 is fed to the surfaces of the photoreceptors 1Y, 1M, 1C, and 1Bk with lubricant feeders (lubricant feeding step). However, this step is not essential.

Then, the toners that remain on the surfaces of the photoreceptors 1Y, 1M, 1C, and 1Bk (residual toners) are cleaned off with cleaners 6Y, 6M, 6C, and 6Bk. Specifically, blades 61 corresponding to the cleaners 6Y, 6M, 6C, and 6Bk abut against the surfaces of the photoreceptors 1Y, 1M, 1C, and 1Bk to scrape off the residual toners. The blade 61 may scrape off the lubricant 122 together with the residual toner. In the present embodiment, the maximum value D of the difference between a first loss tangent at 1 Hz and a second loss tangent at 100 Hz of the blade 61 satisfies the above-described formula (1). Accordingly, deterioration in cleaning characteristics depending on operating conditions can be minimized (detailed descriptions will be given later).

When the toners that remain on the surface of the photoreceptors 1Y, 1M, 1C, and 1Bk have been cleaned off, the photoreceptors 1Y, 1M, 1C, and 1Bk are negatively charged with the chargers 2Y, 2M, 2C, and 2Bk for the next image forming process.

On the other hand, a sheet P is fed from a sheet feeding cassette 20 by a sheet feeder 21, and delivered to a second transferer (second transferring rollers) 5*b* via a plurality of intermediate rollers 22A, 22B, 22C, and 22D and a register roller 23. Then, the color image is transferred to the sheet P with the second transferer 5*b* (second transfer).

The sheet P to which the color image has been transferred as described above is subjected to a fixing treatment by a fixer 24, thereafter held between sheet discharging rollers 25 and discharged from the apparatus by the rollers, and dropped on a sheet receiving tray 26. After the sheet P is detached from the intermediate transfer body 70, the residual toner on the intermediate transfer body 70 is removed by a cleaner 6*b*.

In an image forming method using the above-described image forming apparatus 100, a lubricant removing step may be performed, if necessary. For example, removing members of lubricant removing sections abut against the surfaces of the photoreceptors 1Y, 1M, 1C, and 1Bk, and the lubricant 122 is mechanically removed (lubricant removing step).

For example, an image can be formed on the sheet P as described above.

(Function and Effect of Image Forming Apparatus)

In the image forming apparatus 100 of the present embodiment, the maximum value D of the difference between a first loss tangent at 1 Hz and a second loss tangent at 100 Hz of the blade 61 satisfies the above-described formula (1). Thus, the abutting states of the blades 61 against the photoreceptors 1Y, 1M, 1C, and 1Bk can be stably maintained even under varying operating conditions while the blades 61 clean the photoreceptors 1Y, 1M, 1C, and 1Bk. Accordingly, the deterioration in cleaning characteristics depending on operating conditions can be minimized. The functions and effects of the image forming apparatus 100 are described below.

When the maximum value D of the difference between the first loss tangent at 1 Hz and the second loss tangent at 100 Hz of the blade does not satisfy the above-described formula (1), it may become difficult to stably maintain the abutting state of the blade against the surface of the photoreceptor due to environmental variation. For example, when the maximum value D is more than 0.7, the blade may show highly viscous characteristics, which results in local abrasion or chipping of the blade at a portion abutting against the photoreceptor. For example, under a high temperature environment, the blade may be excessively pulled toward the rotation direction of the photoreceptor at a portion abutting against the photoreceptor, leading to a burr of the blade. Even in the case where the burr is not produced, when the blade is excessively pulled continuously at a portion abutting against the photoreceptor for a long time, weakening (permanent elongation) tends to occur. When such a burr is produced or weakening occurs, for example, the residual toner on the surface of the photoreceptor may be insufficiently removed. On the other hand, under a low temperature environment, the blade becomes stiff, and the abutting state of the blade against the photoreceptor tends to be uneven. Furthermore, under a low temperature environment, external additives are easily detached from the toner base particle. When these external additives are intermittently fed to the blade, pulling of the blade becomes insufficient, and escape of a toner tends to occur.

When the maximum value D is more than 0.7, in addition, the abutting state of the blade against the surface of the photoreceptor may become unstable due to variation in vibration derived from the machine (vibration in the machine), resulting in insufficient removal of the residual toner or the like on the surface of the photoreceptor. Examples of the vibration associated with the blade include oscillation of the photoreceptor. The period of the oscillation of the photoreceptor varies depending on the diameter of the shaft and the rotational speed of the photoreceptor, and the frequency varies within a range of several Hz to several tens Hz, specifically, about 1 Hz to about 100 Hz.

When the maximum value D is less than 0.2, it may be possible to minimize the unstable abutting state of the blade against the surface of the photoreceptor due to variation in temperature and variation in vibration derived from the machine (variation infrequency). However, even when the maximum value D is less than 0.2, if the first loss tangent and the second loss tangent are too small, the blade tends to show highly elastic characteristics, resulting in vibration of the blade itself, that is, so-called stick-slip. Thus, the abutting state of the blade against the surface of the photoreceptor may become unstable due to this stick-slip.

On the other hand, in the image forming apparatus 100, the maximum value D of the difference between a first loss tangent at 1 Hz and a second loss tangent at 100 Hz of the blade 61 satisfies the above-described formula (1). Thus, the stick-slip can be prevented, and the variation in the abutting state of the blade 61 against the surfaces of the photoreceptors 1Y, 1M, 1C, and 1Bk due to environmental variations can be also reduced. Specifically, when the maximum value D is 0.7 or less, the unstable abutting state of the blade 61 against the surfaces of the photoreceptors 1Y, 1M, 1C, and 1Bk due to environmental variations such as variation in temperature and variation in vibration derived from the machine can be minimized. On the other hand, when the maximum value D is 0.2 or more, an appropriate first loss tangent value and an appropriate second loss tangent value can be easily maintained, and the viscous characteristics of the blade 61 can be easily retained. That is, the occurrence of the stick-slip can be prevented.

In addition, since the blade 61 has an abutting layer 611 and a supporting layer 612, functions can be shared between the abutting layer 611 and the supporting layer 612 so that the maximum value D satisfies the above-described formula (1). In a case where the blade has a single-layer configuration, even when the maximum value D satisfies the above-described formula (1), it may be difficult to realize both retaining the viscous characteristics of the blade in the vicinity of the surface of the photoreceptor and maintaining the abutting state of the blade against the photoreceptor under various operating conditions, and insufficient cleaning characteristics may be achieved. On the other hand, when the functions are shared between the abutting layer 611 and the supporting layer 612, it becomes possible to realize both retaining the viscous characteristics of the blades in the vicinity of the surfaces of the photoreceptors 1Y, 1M, 1C, and 1Bk and maintaining the abutting state of the blades against the photoreceptors under various operating conditions. For example, the loss tangent of the abutting layers 611 that abut the surfaces of the photoreceptors 1Y, 1M, 1C, and 1Bk is relatively increased, and the loss tangent of the supporting layers 612 that support the abutting layers 611 is relatively decreased. Alternatively, the thickness T1 of the abutting layer 611 is relatively decreased, and the thickness T2 of the supporting layer 612 is relatively increased. For example, when the functions are shared between the abutting layer 611 and the supporting layer 612, it becomes possible to maintain the abutting state of the blades 61 against the photoreceptors 1Y, 1M, 1C, and 1Bk under various operating conditions while stably retaining the viscous characteristics of the blades 61 in the vicinity of the surfaces of the photoreceptors 1Y, 1M, 1C, and 1Bk.

As described above, in the image forming apparatus 100 of the present embodiment, since the maximum value D of the difference between a first loss tangent at 1 Hz and a second loss tangent at 100 Hz of the blade 61 satisfies the above-described formula (1), the abutting state of the blades 61 against the photoreceptors 1Y, 1M, 1C, and 1Bk can be stably maintained even under varying operating conditions while the blades 61 clean the photoreceptors 1Y, 1M, 1C, and 1Bk. Accordingly, the deterioration in cleaning characteristics depending on operating conditions can be minimized.

On the other hand, it is preferred that the average height of raised parts $R_1$ (nm) of the outermost layers of the photoreceptors 1Y, 1M, 1C, and 1Bk, the average distance between raised parts $R_2$ (nm) of the raised structures constituted by protrusions of the inorganic filler on the outermost layer, and the approximated spherical toner particle diameter $R_3$ (nm) satisfy the above-described formulae (5) to (7). Then, the cleaning characteristics can be further increased.

Modification Example

Figure 7:
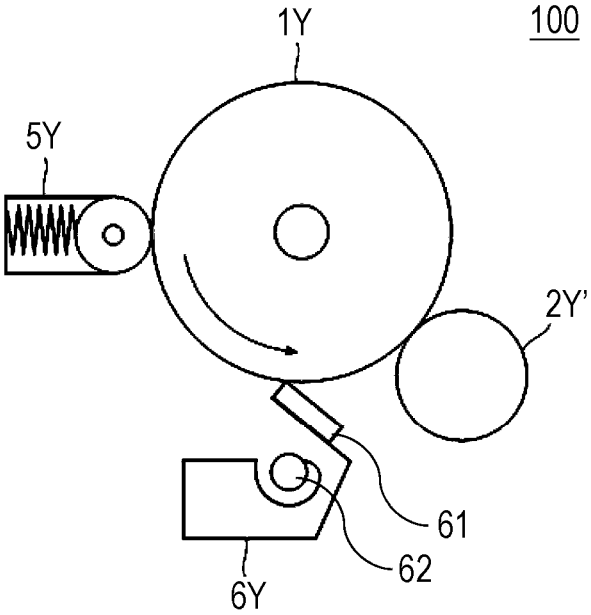
FIG. 7 is an illustration showing a configuration of an important part of an image forming apparatus according to a modification example.

FIG. 7 shows a cross-sectional constitution of an important part of an image forming apparatus 100 according to a modification example of the above-described embodiment. This image forming apparatus 100 has a charger 2Y' instead of the charger 2Y (see, FIG. 2). Except for this modification, the image forming apparatus 100 according to the modification example has the same configuration as that of the image forming apparatus 100 of the above-described embodiment.

The charger 2Y' is a proximity charging type charging unit. This charger 2Y' has, for example, a charging roller, and a power supply for applying a voltage to the charging roller.

The charging roller is disposed in contact with or in the vicinity of the surface of the photoreceptor 1Y. The charging roller includes, for example, a core bar, and an elastic layer formed around the core bar. When the charging roller has the elastic layer, charging noise is reduced, and the charging roller can be bought into uniformly and closely contact with the photoreceptor 1Y. The charging roller may further have a resistance control layer and a surface layer in this order on the surface of the elastic layer. When the charging roller has a resistance control layer, uniform electrical resistance across the charging roller can be easily achieved. The charging roller is biased toward the photoreceptor 1Y by, for example, a pressing spring. As a result, the charging roller is pressed against and brought into contact with the surface of the photoreceptor 1Y to form a charging nip portion between the charging roller and the photoreceptor 1Y. The charging roller is driven and rotated by the rotation of the photoreceptor 1Y.

As described above, the image forming apparatus 100 may have a proximity charging type charger 2Y'. This image forming apparatus 100 has the same function and effect as those of the image forming apparatus 100 described in the above-described embodiment.

Examples

The effects of the present invention will be described using Examples and Comparative Examples below. However, the technical scope of the invention is not limited to the following examples. In the following examples, unless otherwise indicated, operations were carried out at room temperature (25° C.). Further, unless otherwise indicated, "%" and "part" refer to "mass %" and "part by mass", respectively.

<Preparation of Metal Oxide Particles Surface Treated with Surface Treatment Agent (Surface-Treated Particles)>

(Preparation of Surface-Treated Particles 1)

[Surface Treatment with Reactive Surface Treatment Agent (Reactive Surface Treatment)]

To 10 mL of methanol was added 5 g of tin oxide (number average primary particle size: 20 nm) as untreated metal oxide particles (untreated base particles), and dispersed at room temperature for 30 minutes with a US homogenizer. Then, 0.25 g of 3-methacryloxypropyltrimethoxysilane (a radically polymerizable group-containing silane coupling agent "KBM-503", manufactured by Shin-Etsu Chemical Co., Ltd.) as a reactive surface treatment agent and 10 mL of toluene were added to the resulting dispersion and stirred at room temperature for 60 minutes. The solvent was removed using an evaporator, and then the mixture was heated at 120° C. for 60 minutes to give metal oxide particles surface treated with the reactive surface treatment agent.

[Surface Treatment with Silicone Surface Treatment Agent (Silicone Surface Treatment)]

Subsequently, 5 g of the metal oxide particles surface treated with the reactive surface treatment agent obtained above were added to 40 g of 2-butanol, and dispersed at room temperature for 60 minutes using a US homogenizer. Then, 0.15 g of a side chain type silicone surface treatment agent having a silicone chain in a side chain of the silicone main chain ("KF-9908", manufactured by Shin-Etsu Chemical Co., Ltd.) was added to the resulting dispersion, and further dispersed at room temperature for 60 minutes using a US homogenizer. After dispersion, the solvent was evaporated at room temperature, and dried at 120° C. for 60 minutes to give surface-treated particles 1 as metal oxide particles surface treated with the reactive surface treatment agent and the silicone surface treatment agent. The surface-treated particle 1 is a particle having a polymerizable group.

(Preparation of Surface-Treated Particles 2 and 3)

Surface-treated particles 2 and 3 were prepared as in the preparation of the surface-treated particles 1, except that the number average primary particle sizes of untreated metal oxide particles as untreated base particles were as shown in Table 1 below. Each of these surface-treated particles was a particle having a polymerizable group.

The compositions of the surface-treated particles 1 to 3 are shown in Table 1 below.

TABLE 1

(Table 1) Inorganic filler

| | Untreated base particle (Untreated metal oxide particle) | | | |
|---|---|---|---|---|
| Surface-treated particle No. | Type | Number average primary particle size (nm) | Silicone surface treatment Surface treatment agent | Reactive surface treatment Surface treatment agent |
| 1 | $SnO_2$ | 20 | KF-9908 | KBM-503 |
| 2 | | 100 | | |
| 3 | | 10 | | |

<Preparation of Photoreceptor>

(1) Preparation of Conductive Support

A conductive support was prepared by machining the surface of a cylindrical aluminum support.

(2) Formation of Intermediate Layer

The following components were mixed in the amounts provided below, and the mixture was dispersed using a sand mill as a disperser for 10 hours by a batch process to prepare a coating liquid for intermediate layer. Then, the resulting coating liquid for intermediate layer was applied onto the above-described conductive support by dip coating, and dried at 110° C. for 20 minutes to prepare an intermediate layer having a dry film thickness of 2 μm;

Polyamide resin (X1010 manufactured by Daicel-Evonik Ltd.) 10 parts by mass,

Titanium oxide (SMT-500SAS manufactured by TAYCA CORPORATION) 11 parts by mass, and Ethanol 200 parts by mass.

(3) Formation of Charge Generating Layer

The following components were mixed in the amounts provided below, and the mixture was dispersed using a circulation type ultrasonic homogenizer (RUS-600TCVP manufactured by NIHONSEIKI KAISHA LTD.) at 19.5 kHz and 600 W over 0.5 hours at a circulating flow rate of 40 L/hour to prepare a coating liquid for charge generation layer. Then, the resulting coating liquid for charge generation layer was applied onto the above-described intermediate layer by dip coating, and dried to prepare a charge generating layer having a dry film thickness of 0.3 μm;

Charge generating material (mixed crystal of 1:1 adduct of titanyl phthalocyanine having distinct peaks at 8.3°, 24.7°, 25.1°, and 26.5° as measured by Cu-Kα characteristic X-ray diffraction spectroscopy and (2R,3R)-2,3-butanediol, and titanyl phthalocyanine (non-adduct)) 24 parts by mass, Poly(vinyl butyral) resin (S-LEC (registered trademark) BL-1 manufactured by SEKISUI CHEMICAL CO., LTD.) 12 parts by mass, and Mixed solvent of 3-methyl-2-butanone/cyclohexanone (3-methyl-2-butanone:cyclohexanone=4:1 (volume ratio)) 400 parts by mass.

(4) Formation of Charge Transporting Layer

The following components were mixed in the amounts provided below to prepare a coating liquid for charge transporting layer. The resulting coating liquid was applied onto the surface of the above-described charge generating layer, and dried at 120° C. for 70 minutes to form a charge transporting layer having a film thickness of 24 μm on the charge transporting layer;

Charge transporting material represented by the following chemical formula (4) 60 parts by mass, Polycarbonate resin (Z300 manufactured by MITSUBISHI GAS CHEMICAL COMPANY, INC.) 100 parts by mass, Antioxidant (IRGANOX (registered trademark) 1010 manufactured by BASF) 4 parts by mass, Mixed solvent of toluene/tetrahydrofuran (toluene:tetrahydrofuran=1:9 (volume ratio)) 800 parts by mass, and Silicone oil (KF-54 manufactured by Shin-Etsu Chemical Co., Ltd.) 1 part by mass.

[Chemical Formula 4]

Chemical Formula (4)

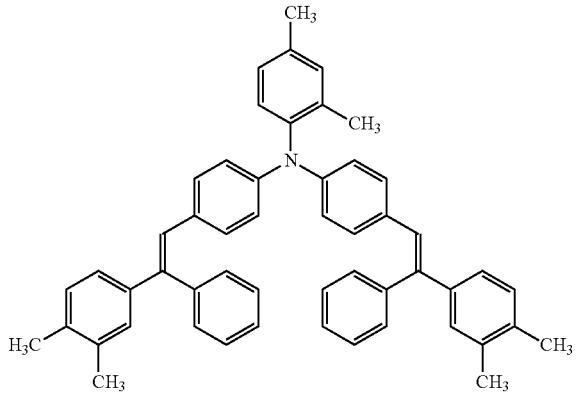

(5) Formation of Protective Layer (Outermost Layer)

The following components were mixed in the amounts provided below to prepare a coating liquid for protective layer (coating liquid for outermost layer). Then, the resulting coating liquid for protective layer was applied onto a charge transporting layer using a circular slide hopper coater, and irradiated with ultraviolet rays at 16 mW/cm$^2$ for 1 minute (integrated light intensity of 960 mJ/cm$^2$) using a metal halide lamp to form a protective layer having a dry film thickness of 3.0 μm. Accordingly, a photoreceptor was prepared.

Radically polymerizable monomer (the above-described compound M2: trimethylolpropane trimethacrylate) 120 parts by mass, Surface-treated particles 1, surface-treated particles 2, or surface-treated particles 3 75 parts by mass to 125 parts by mass, Polymerization initiator (Ominirad (registered trademark) 819 manufactured by IGM Resins B. V.) 10 parts by mass, and 2-Butanol 400 parts by mass.

In each of the photoreceptors prepared by the above-described method, the protective layer corresponds to an outermost layer.

In the protective layer of the photoreceptor, it was confirmed that there was silicon that was a chemical species derived from the silicone surface treatment agent on the surface of the metal oxide particles of the silicone surface-treated particles 1 to 3.

In addition, it is speculated that the surface-treated particles 1 to 3 each having a polymerizable functional group reacted with a radically polymerizable monomer in the protective layer of the photoreceptor, and thus had a group derived from the polymerizable group.

<Evaluation of Photoreceptor>

(Analysis of Raised Structure of Outermost Layer)

With respect to the resulting photoreceptor, a photographic image of the surface of the photoreceptor captured using a scanning electron microscope (SEM) ("JSM-7401F", manufactured by JEOL Ltd.) was visually observed, and it was confirmed that most raised structures of the outermost layer were constituted by protruded metal oxide particles.

(Measurement of Average Height of Raised Parts $R_1$ of Outermost Layer)

With respect to the resulting photoreceptor, the surface of the protective layer was subjected to 3D measurement using a surface roughness analysis 3D scanning electron microscope ("ERA-600FE", manufactured by ELIONIX INC.), the average height of contour curve elements was calculated in 3D analysis, and the resulting average height was defined as the average height of raised parts $R_1$ of the outermost layer. $R_1$ of each photoreceptor is shown as an average height of raised parts in Table 2 below.

(Measurement of Average Distance Between Raised Parts $R_2$ of Raised Structures Constituted by Protrusions of Inorganic Filler on Outermost Layer)

With respect to the resulting photoreceptor, a photographic image of the surface of the protective layer captured using a scanning electron microscope (SEM) ("JSM-7401F", manufactured by JEOL Ltd.) was read with a scanner, parts of surface-treated particles (metal oxide particles) in the photographic image was binarized with an image processing and analysis device ("LUZEX AP", manufactured by NIRECO CORPORATION), and the distance between two surface-treated particles (metal oxide particles) was calculated. This calculation was repeated, and 50 distances between different pairs of surface-treated particles (metal oxide particles) were obtained. Then, the average distance was calculated, and this average was defined as the average distance between raised parts of the outermost layer. The average distance between raised parts $R_2$ of each photoreceptor is shown in Table 2 below.

<Production of Blade>

As described in the above-described embodiment, a blade was produced by molding polyurethane using a centrifugal molding machine. In this production of a blade, a blade having a two-layer configuration consisting of an abutting layer and a supporting layer and a blade having a single-layer configuration consisting only of an abutting layer were produced.

<Evaluation of Blade>

(Measurement of Thicknesses T1 and T2)

The thickness T1 of the abutting layer and the thickness T2 of the supporting layer of the blade produced above were measured using a microscope VHX-600 (manufactured by KEYENCE CORPORATION). The thicknesses T1 and T2 obtained above are shown in Table 2 below.

(Measurement of Maximum Values D, D1, and D2)

At temperatures within a range of 0° C. to 50° C., temperature dependent changes in a first loss tangent at 1 Hz and temperature dependent changes in a second loss tangent at 100 Hz of the blade prepared above were measured to calculate the maximum value D of the difference between the first loss tangent and the second loss tangent. At temperatures within a range of 0° C. to 50° C., temperature dependent changes in a third loss tangent at 1 Hz and temperature dependent changes in a fourth loss tangent at 100 Hz of the abutting layer were measured to calculate the maximum value D1 of the difference between the third loss tangent and the fourth loss tangent. At temperatures within a range of 0° C. to 50° C., temperature dependent changes in a fifth loss tangent at 1 Hz and temperature dependent changes in a sixth loss tangent at 100 Hz of the supporting layer were measured to calculate the maximum value D2 of the difference between the fifth loss tangent and the sixth loss tangent. In the blade having a single-layer configuration consisting only of the abutting layer, the maximum value D1 was considered as the maximum value D.

The values of the first loss tangent to the sixth loss tangent were measured using a dynamic viscoelasticity measuring device (viscoelasticity analyzer RSA-G2 manufactured by TA Instruments). The temperature dependent changes in the first loss tangent, the third loss tangent, and the fifth loss tangent were measured as follows. A sample (an abutting layer, a supporting layer, or a multilayer structure including an abutting layer and a supporting layer) was mounted on the above-described dynamic viscoelasticity measuring device such that a portion of the sample having a length of 30 mm was analyzed. Then, a sine wave distortion with a displacement amplitude of ±10 μm and a frequency of 1 Hz was applied to the sample, and the sample was heated in steps of 2° C. within a temperature range of −10° C. to 54° C. to measure the first loss tangent, the third loss tangent, and the fifth loss tangent at each step (every 2° C.). The temperature dependent changes in the second loss tangent, the fourth loss tangent, and the sixth loss tangent were measured as in the above-described measurement of temperature dependent changes in the first loss tangent, the third loss tangent, and the fifth loss tangent, except that the frequency of the sine wave distortion was 100 Hz. The maximum values D, D1, and D2 calculated from the first loss tangent to the sixth loss tangent obtained above are shown in Table 2 below.

<Preparation of Toner>

(Preparation of Toner)

(1) Preparation of Toner Base Particles (1.1) Preparation of Dispersion of Resin Particles a for Core Portion (1.1.1) First Polymerization Stage A reaction container equipped with a stirrer, a temperature sensor, a temperature control device, a cooling tube, and a nitrogen inlet was charged with an anionic surfactant solution which was prepared in advance by dissolving 2.0 parts by mass of sodium lauryl sulfate as an anionic surfactant in 2900 parts by mass of deionized water, and the internal temperature was raised to 80° C. with stirring at a rotational speed of 230 rpm under nitrogen flow.

To the anionic surfactant solution was added 9.0 parts by mass of potassium persulfate (KPS) as a polymerization initiator, and the internal temperature was adjusted to 78° C. To the resulting anionic surfactant solution containing the polymerization initiator, a monomer solution 1, in which the following components were mixed in the amounts provided below, was added dropwise over 3 hours. After this dropwise addition, the mixture was heated and mixed at 78° C. over 1 hour to cause polymerization (first polymerization stage). Accordingly, a dispersion of resin particles a1 was prepared;

Styrene 540 parts by mass,
n-Butyl acrylate 154 parts by mass,
Methacrylic acid 77 parts by mass, and
n-Octyl mercaptan 17 parts by mass.

(1.1.2) Second Polymerization Stage: Formation of Intermediate Layer

The following components were mixed in the amounts provided below, and 51 parts by mass of paraffin wax (melting point: 73° C.) as an offset preventing agent was added to the mixture and melted by heating to 85° C. to prepare a monomer solution 2;

Styrene 94 parts by mass,
n-Butyl acrylate 27 parts by mass,
Methacrylic acid 6 parts by mass, and
n-Octyl mercaptan 1.7 parts by mass.

A surfactant solution, in which 2 parts by mass of sodium lauryl sulfate as an anionic surfactant was dissolved in 1100 parts by mass of deionized water, was heated to 90° C. To the surfactant solution, the dispersion of the resin fine particles a1 was added in an amount of 28 parts by mass as a solid content of the resin particles a1, then the monomer solution 2 was dispersed in the mixture by mixing for 4 hours with a mechanical dispersing machine ("CREAMIX (registered trademark)", manufactured by M Technique Co., Ltd.) having a circulation path to prepare a dispersion containing emulsified particles having a dispersion particle size of 350 nm. To the resulting dispersion, an initiator aqueous solution, in which 2.5 parts by mass of KPS as a polymerization initiator was dissolved in 110 parts by mass of deionized water, was added, and this system was heated and mixed at 90° C. over 2 hours to cause polymerization (second polymerization stage). Accordingly, a dispersion of resin particles all was prepared.

(1.1.3) Third Polymerization Stage: Formation of Outer Layer (Preparation of Resin Particles a for Core Portion)

To the dispersion of the resin particles all, an initiator aqueous solution, in which 2.5 parts by mass of KPS as a polymerization initiator was dissolved in 110 parts by mass of deionized water, was added. To the resulting mixture, a monomer solution 3, in which the following components were mixed in the amounts described below, was added dropwise at a temperature of 80° C. over 1 hour. After this dropwise addition, the mixture was heated and mixed over 3 hours to cause polymerization (third polymerization stage). Then, the mixture was cooled to 28° C. to prepare a dispersion of resin particles A for core portion in which resin particles A for core portion was dispersed in the anionic surfactant solution. The resin particles A for core portion had a glass transition temperature of 45° C. and a softening point of 100° C.

Styrene 230 parts by mass,
n-Butyl acrylate 78 parts by mass,
Methacrylic acid 16 parts by mass, and
n-Octyl mercaptan 4.2 parts by mass.

(1.2) Preparation of Dispersion of Resin Particles B for Shell Layer (1.2.1) Synthesis of Resin for Shell Layer (Styrene-Acrylic Modified Polyester Resin B)

A 10-L four-neck flask equipped with a nitrogen intake pipe, a drainpipe, a mixer, and a thermocouple was charged with the following component 1 in the amounts provided below. The resulting mixture was subjected to a polycondensation reaction at 230° C. for 8 hours, followed by reaction at 8 kPa for 1 hour, and the reaction mixture was cooled to 160° C.;

(Component 1)
Bisphenol A-propylene oxide 2 mol adduct 500 parts by mass,
Terephthalic acid 117 parts by mass,
Fumaric acid 82 parts by mass, and
Esterification catalyst (tin octylate) 2 parts by mass.

Then, to the cooled solution described above, a mixture in which the following component 2 was mixed in the amounts provided below was added dropwise using a dropping funnel over 1 hour. After the dropwise addition, the addition polymerization reaction was continued for 1 hour while the temperature was kept at 160° C., then the temperature was raised to 200° C. The reaction mixture was allowed to stand at 10 kPa for 1 hour, and then unreacted acrylic acid, styrene, and butyl acrylate were removed to give a styrene-acrylic modified polyester resin B. The resulting styrene-acrylic modified polyester resin B had a glass transition temperature of 60° C. and a softening point of 105° C.

(Component 2)
Acrylic acid 10 parts by mass,
Styrene 30 parts by mass,
Butyl acrylate 7 parts by mass, and
Polymerization initiator (di-t-butyl peroxide) 10 parts by mass.

(1.2.2) Preparation of Dispersion of Resin Particles B for Shell Layer

The resulting styrene-acrylic modified polyester resin B (100 parts by mass) was crushed with a grinder (roundel mill, RM type; TOKUJU CORPORATION), mixed with 638 parts by mass of a sodium lauryl sulfate solution, which was prepared in advance, having a concentration of 0.26 mass %, and ultrasonically dispersed with stirring for 30 minutes using an ultrasonic homogenizer ("US-150T", manufactured by NIHONSEIKI KAISHA LTD.) at V-level and 300 μA to prepare a dispersion of resin particles B for shell layer in which the resin particles B for shell layer having a number median diameter (D50) of 250 nm were dispersed.

(1.3) Preparation of Dispersion of Colorant Particles 1

Sodium dodecyl sulfate (90 parts by mass) was dissolved in 1600 parts by mass of deionized water by stirring. To the resulting solution was gradually added 420 parts by mass of carbon black ("MOGUL L", manufactured by Cabot) with stirring, and then dispersed using a stirrer ("CREAMIX (registered trademark)", manufactured by M Technique Co., Ltd.) to prepare a dispersion of colorant particles 1 in which colorant particles were dispersed. The colorant particles in this dispersion had a particle size of 117 nm as measured using a Microtrac particle size distribution analyzer ("UPA-150", manufactured by NIKKISO CO., LTD.).

(1.4) Preparation of Toner Base Particles (Aggregation, Fusing-Washing-Drying)

A reaction container equipped with a stirrer, a temperature sensor, and a cooling tube was charged with the dispersion of resin particles A for core portion in an amount of 288 parts by mass as a solid content and 2000 parts by mass of deionized water, and 5 mol/L of a sodium hydroxide aqueous solution was added to adjust the pH to 10 (25° C.).

To the dispersion, the dispersion of colorant particles 1 was added in an amount of 40 parts by mass as a solid content. To the mixture, a magnesium chloride aqueous solution in which 60 parts by mass of magnesium chloride was dissolved in 60 parts by mass of deionized water was added at 30° C. over 10 minutes with stirring. The solution was allowed to stand for 3 minutes, thereafter heating was started to raise the temperature to 80° C. over 60 minutes, and a particle growth reaction was continued while the temperature was kept at 80° C. Under this condition, the particle sizes of core particles were measured with a precise particle size distribution analyzer ("Multisizer 3", manufactured by Beckman Coulter, Inc.). When the number median diameter (D50) of the core particles reached 5.8 μm, the dispersion of the resin particles B for shell layer were added in an amount of 72 parts by mass as a solid content over 30 minutes. When the supernatant of the reaction solution became clear, a sodium chloride aqueous solution prepared by dissolving 190 parts by mass of sodium chloride in 760 parts by mass of deionized water was added to stop the growth of the particles. Then, the mixture was heated, and the particles were fused by heating and stirring at 90° C. When the average circularity reached 0.945 as analyzed using an analyzer for toner average circularity ("FPIA-2100", manufactured by SYSMEX CORPORATION) (with an HPF detection number setting of 4000), the mixture was cooled to 30° C. to give a dispersion of toner base particles.

This dispersion of toner base particles was subjected to solid-liquid separation with a centrifuge to form a wet cake of the toner base particles. The wet cake was washed with deionized water at 35° C. until the electrical conductivity of the filtrate reached 5 μS/cm. Then, the resultant was dried with an airflow dryer ("a flash jet dryer", manufactured by Seishin Enterprise Co., Ltd.) until the water content reached 0.5 mass % to give desired toner base particles.

The toner base particles had a number median diameter (D50) as a particle diameter of 6.0 μm as measured using a precise particle size distribution analyzer ("Multisizer 3", manufactured by Beckman Coulter, Inc.). In addition, toner base particles having a number median diameter (D50) of 3.5 μm were produced as in the production of the above-described toner base particles, except that the time of the particle growth reaction was changed.

(2) Preparation of Toner

To 100 parts by mass of the toner base particles, as external additives, 1.0 parts by mass of $SiO_2$ particles (number average primary particle size: 80 nm) as large-diameter particles and 0.3 parts by mass of hydrophobic titania particles (number average primary particle size: 20 nm) were added, and mixed using a Henschel mixer to prepare a toner.

<Evaluation of Toner>

(Calculation of Approximated Spherical Toner Particle Diameter $R_3$)

With respect to the toner prepared above, 3D measurement of the toner was carried out using a surface roughness analysis 3D scanning electron microscope ("ERA-600FE", manufactured by ELIONIX INC.), and roughness was analyzed by 3D analysis to calculate the average height of raised parts from the surface of the toner base particle (average height of raised parts of external additives (nm)). Next, the approximated spherical toner particle diameter was calculated according to the following formula. As the diameters of the toner base particles in the calculation, the number median diameters (D50) of 6.0 μm (6,000 nm) and 3.5 μm (3,500 nm) as measured in the above-described toner preparations were used. The average height of raised parts of external additives and the approximated spherical toner particle diameter $R_3$ of each toner are shown in Table 2 below.

$R_3$ [nm]=(diameter of toner base particle [nm]+average height of raised parts of external additives [nm]×2)/2 [Mathematical Formula 11]

(Calculation of Coverage of Toner Base Particle)

With respect to the toner prepared above, a photographic image of the toner captured using a scanning electron microscope (SEM) ("JSM-7401F", manufactured by JEOL Ltd.) was read with a scanner, and external additive metal oxide particles in the photographic image were binarized with an image processing and analysis device ("LUZEX AP", manufactured by NIRECO CORPORATION). Then, the area (%) occupied with the external additive metal oxide particles on one toner particle relative to the surface area of the toner particle was calculated. The above-described calculation of occupancy was repeated for 10 toner particles in total, and the average of the calculated occupancies for the 10 toner particles was defined as a coverage (%) of a toner base particle. The coverage of a toner base particle of each toner is shown in Table 2 below.

<Evaluation of Image Forming Apparatus and Image Forming Method>

(Preparation of Image Forming Apparatus) The photoreceptor and the toner prepared above were combined as shown in Table 2 below, and installed in a full-color printer ("bizhub PRESS (registered trademark) C1070", manufactured by KONICA MINOLTA, INC.). Accordingly, image forming apparatus 1 to 15 shown in Table 2 below were prepared. In each of the image forming apparatuses 1 to 11, the blade had a multilayer configuration of an abutting layer and a supporting layer, and the maximum value D of the difference between a first loss tangent at 1 Hz and a second loss tangent at 100 Hz of the blade satisfies the above-described formula (1). The image forming apparatuses 1 to 11 correspond to Examples 1 to 11, respectively (see, Table 2). In each of the image forming apparatuses 12 and 13, the maximum value D did not satisfy the above-described formula (1). In each of the image forming apparatuses 14 and 15, the blade had a single-layer configuration consisting only of an abutting layer. These image forming apparatuses 12 to 15 correspond to Comparative Examples 1 to 4, respectively (see, Table 2).

(Evaluation of Cleaning Characteristics Under Condition 1)

In each of the image forming apparatuses 1 to 15, a lubricant feeder was adjusted to achieve a lubricant consumption corresponding to 0.05 g/km (condition 1). Specifically, the pressure applied by a pressure spring is adjusted so that a brush roller of the lubricant feeder abutted against the photoreceptor with a pressure of 0.55 N.

Then, test images each having two solid lengthwise-striped images (width: 5 cm) were continuously printed onto 100,000 sheets of transversely fed size A4 sheets under an environment at a low temperature and a low humidity of 10° C. and 15% RH (LL environment) and under an environment at a high temperature and a high humidity of 30° C. and 85% RH (HH environment).

Thereafter, halftone images each having a black part on the front side and a white part on the rear side in the paper transport direction were printed onto 100 sheets of A3 neutral paper. Then, in the white part in the 100th print, whether there was a stain such as a streak produced by an escaped toner that had escaped from the blade or not was visually observed. Furthermore, with respect to contamination of the brush roller of the lubricant feeder, whether there was contamination produced by an escaped external additive that had escaped from the blade or not was visually observed. By the above-described visual observations of the stain such as a streak on the white part and the contamination of the brush roller, cleaning characteristics under the condition 1 were evaluated according to the following evaluation criteria. In this evaluation, evaluation results with "A" and "B" were acceptable.

[Evaluation Criteria]

A: There is no contamination of a lubricant application brush, and there is no streak of stain on the white part;

B: There is a slight contamination of a lubricant application brush, but no streak of stain is visually observed, which is suitable for practical application;

C: There is a contamination of a lubricant application brush, and streaks of stain are visually observed.

(Evaluation of Cleaning Characteristics Under Condition 2)

In each of the image forming apparatuses 1 to 15, a lubricant feeder was adjusted to achieve a lubricant consumption corresponding to 0.10 g/km (condition 2). Specifically, the pressure applied by a pressure spring is adjusted so that a brush roller of the lubricant feeder abutted against the photoreceptor with a pressure of 1.1 N. Except for the foregoing, cleaning characteristics under the condition 2 were evaluated as in the evaluation of cleaning characteristics under the condition 1.

The features of the blade, the photoreceptor, and the toner of each of the image forming apparatuses 1 to 15 are shown in Table 2 below. The evaluation results of the cleaning characteristics under conditions 1 and 2 using the image forming apparatuses 1 to 15 are shown in Table 3 below.

TABLE 2

Blade, photoreceptor, and toner installed in each image forming apparatus

| Image forming apparatus No. | Blade T1 (mm) | T2 (mm) | T1 + T2 (mm) | D1 | D2 | D | Electrophotographic photoreceptor Surface-treated particle No. | Average height of raised parts $R_1$ [nm] | Average distance between raised parts $R_2$ [nm] | Toner External additive (large-diameter particles) Type | Particle size [nm] | Average height of raised parts of external additive [nm] | Approximated spherical toner particle diameter $R_3$ [nm] | $R_2'$ [nm] | |
|---|---|---|---|---|---|---|---|---|---|---|---|---|---|---|---|
| 1 | 1.2 | 0.6 | 1.8 | 0.95 | 0.50 | 0.70 | 2 | 30 | 320 | $SiO_2$ | 80 | 25 | 3025 | 850 | Example 1 |
| 2 | 0.5 | 1.5 | 2.0 | 0.70 | 0.90 | 0.65 | 3 | 4 | 240 | | | | 1775 | 238 | Example 2 |
| 3 | 0.4 | 1.6 | 2.0 | 0.60 | 0.70 | 0.25 | 2 | 30 | 320 | | | | 3025 | 850 | Example 3 |
| 4 | 0.4 | 1.4 | 1.8 | 0.40 | 0.50 | 0.50 | 2 | 30 | 320 | | | | 3025 | 850 | Example 4 |
| 5 | 0.5 | 1.5 | 2.0 | 0.95 | 0.35 | 0.60 | 1 | 10 | 240 | | | | 3025 | 492 | Example 5 |
| 6 | 0.5 | 1.5 | 2.0 | 0.35 | 0.45 | 0.25 | 1 | 10 | 240 | | | | 3025 | 492 | Example 6 |
| 7 | 0.4 | 1.4 | 1.8 | 0.50 | 0.65 | 0.35 | 2 | 30 | 140 | | | | 3025 | 850 | Example 7 |
| 8 | 0.5 | 1.5 | 2.0 | 0.40 | 0.60 | 0.45 | 2 | 30 | 140 | | | | 3025 | 850 | Example 8 |
| 9 | 0.5 | 1.5 | 2.0 | 0.85 | 0.55 | 0.55 | 2 | 30 | 140 | | | | 3025 | 850 | Example 9 |
| 10 | 0.4 | 1.6 | 2.0 | 0.65 | 0.50 | 0.45 | 2 | 30 | 140 | | | | 3025 | 850 | Example 10 |
| 11 | 0.5 | 1.5 | 2.0 | 0.45 | 0.45 | 0.40 | 2 | 30 | 140 | | | | 3025 | 850 | Example 11 |
| 12 | 0.5 | 1.5 | 2.0 | 0.80 | 0.40 | 0.16 | 2 | 30 | 140 | | | | 3025 | 850 | Comparative Example 1 |
| 13 | 0.4 | 1.6 | 2.0 | 0.60 | 0.90 | 0.75 | 2 | 30 | 140 | | | | 3025 | 850 | Comparative Example 2 |
| 14 | 2.0 | — | 2.0 | 0.40 | — | 0.40 | 2 | 30 | 140 | | | | 3025 | 850 | Comparative Example 3 |
| 15 | 2.0 | — | 2.0 | 0.70 | — | 0.70 | 2 | 30 | 140 | | | | 3025 | 850 | Comparative Example 4 |

TABLE 3

(Table 3) Evaluation results of electrophotographic image forming apparatuses and electrophotographic image forming methods

| Image forming apparatus No. | Cleaning characteristics Condition 1 (Lubricant consumption 0.04 g/km) HH | LL | Condition 2 (Lubricant consumption 0.08 g/km) HH | LL | |
|---|---|---|---|---|---|
| 1 | B | B | B | B | Example 1 |
| 2 | B | B | B | B | Example 2 |
| 3 | B | B | A | B | Example 3 |
| 4 | B | B | A | A | Example 4 |
| 5 | A | B | A | A | Example 5 |
| 6 | A | B | A | B | Example 6 |
| 7 | A | B | A | B | Example 7 |
| 8 | A | B | A | A | Example 8 |
| 9 | A | A | A | A | Example 9 |
| 10 | A | A | A | A | Example 10 |
| 11 | A | A | A | A | Example 11 |
| 12 | C | C | B | C | Comparative Example 1 |
| 13 | C | C | B | B | Comparative Example 2 |
| 14 | B | C | A | C | Comparative Example 3 |
| 15 | B | C | A | C | Comparative Example 4 |

The following were confirmed from the results shown in Table 3.

In the image forming apparatuses 1 to 11 (Examples 1 to 11), in each of which the blade had a multilayer configuration of an abutting layer and a supporting layer, and the maximum value D satisfied the above-described formula (1), the deterioration in cleaning characteristics is minimized even under varying operating conditions including temperature and humidity as compared to the image forming apparatuses 12 to 15 (Comparative Examples 1 to 4). Furthermore, in image forming apparatuses 4 and 7 to 11, in each of which the maximum value D satisfied the above-described formula (2), the deterioration in cleaning characteristics due to variations in operating conditions can be more effectively minimized.

In addition, in the image forming apparatuses 9 to 11, in each of which the maximum value D satisfied the above-described formula (2) and the maximum values D1 and D2 satisfied the above-described formulae (3) and (4), respectively, sufficient cleaning characteristics were achieved under any of the conditions (conditions LL and HH under each of the conditions 1 and 2).

Further, in the image forming apparatuses 5 to 11, in each of which the average height of raised parts $R_1$ (nm) of the outermost layer, the average distance between raised parts $R_2$ (inn) of raised structures constituted by protrusions of the inorganic filler of the outermost layer, and the approximated spherical particle diameter $R_3$ (nm) of the toner satisfied the relationships of the above-described formulae (5) to (7), excellent cleaning characteristics were achieved.

The configuration of the image forming apparatus 100 as described above is merely a representative configuration provided for the purpose of describing characteristics of the above-described embodiment, and various modifications may be made to the configuration within the scope of the appended claims. Further, any configuration included in a common image forming apparatus is not excluded.

For example, although the image forming apparatus 100 has a heating roller type fixer 24 in the description of the above-described embodiment, the image forming apparatus 100 may have a belt heating type fixer 24.

Further, in the description of the above-described exemplary embodiment, the blades 61 of the cleaners 6Y, 6M, 6C, and 6Bk each have a multilayer configuration of an abutting layer and a supporting layer, and the maximum value D of the difference between the first loss tangent and the second loss tangent of the blade 61 satisfies the above-described formula (1). However, in other embodiments, a blade of the cleaner 6*b*, that is, a blade that cleans the surface of the intermediate transfer body 70 may have a multilayer configuration of an abutting layer and a supporting layer, and the maximum value D of the first loss tangent and the second loss tangent of this blade may satisfy the above-described formula (1). In this case, the blade of the cleaner 6*b* corresponds to a specific example of the blade of the present invention, and the intermediate transfer body 70 corresponds to a specific example of the toner image retainer of the present invention. Alternatively, both the blades 61 of the cleaners 6Y, 6M, 6C, and 6Bk and the blade of the cleaner 6*b* may have a multilayer configuration of an abutting layer and a supporting layer, and the maximum value D of the difference between the first loss tangent and the second loss tangent of each of the blades 61 may satisfy the above-described formula (1).

Further, in the description of the above-described embodiment, a sheet P is used as an image receiving material that receives an image from the intermediate transfer body 70. However, the image receiving material is not particularly limited as long as the material can retain the image. Examples of the image receiving material may include normal paper such as thin paper and thick paper, high quality paper, art paper, coated printing paper such as coat paper, Japanese paper, a postcard, a plastic film for OHP, fabric, a resin material used for flexible packaging, a resin film, and a label.

Although embodiments of the present invention have been described and illustrated in detail, the disclosed embodiments are made for purposes of illustration and example only and not limitation. The scope of the present invention should be interpreted by terms of the appended claims.

What is claimed is:

1. A method of producing a blade for cleaning a toner image retainer, the method comprising:

binding an abutting layer that abuts against the toner image retainer and a supporting layer that supports the abutting layer, wherein the maximum value D of a difference between a first loss tangent (Tan δ) at 1 Hz and a second loss tangent at 100 Hz of the blade that includes the abutting layer and the supporting layer satisfies formula (1):

[Mathematical Formula 1]

$$0.2 \leq D \leq 0.7 \quad (1)$$

wherein the maximum value D is a maximum value of a difference between the first loss tangent and the second loss tangent at temperatures within a range of 0° C. to 50° C.

2. The method of producing a blade according to claim 1, wherein the maximum value D further satisfies formula (2):

[Mathematical Formula 2]

$$0.35 \leq D \leq 0.55 \quad (2)$$

3. The method of producing a blade according to claim 1, comprising:

forming the abutting layer with a thickness of 0.2 mm or more and 1.0 mm or less, and forming the supporting layer with a thickness of 0.8 mm or more and 2.0 mm or less.

4. The method of producing a blade according to claim 1, wherein the maximum value D1 of a difference between a third loss tangent at 1 Hz and a fourth loss tangent at 100 Hz of the abutting layer satisfies formula (3), and the maximum value D2 of a difference between a fifth loss tangent at 1 Hz and a sixth loss tangent at 100 Hz of the supporting layer satisfies formula (4):

[Mathematical Formula 3]

$$0.45 \leq D1 \leq 0.90 \quad (3)$$

$$0.35 \leq D2 \leq 0.60 \quad (4)$$

wherein the maximum value D1 is a maximum value of a difference between the third loss tangent and the fourth loss tangent at temperatures within a range of 0° C. to 50° C., and the maximum value D2 is a maximum value of a difference between the fifth loss tangent and the sixth loss tangent at temperatures within a range of 0° C. to 50° C.

5. The method of producing a blade according to claim 1, wherein the blade includes two layers formed by the abutting layer and the supporting layer.

6. The method of producing a blade according to claim 1, comprising forming the abutting layer and the supporting layer using polyurethane.

7. A blade for cleaning a toner image retainer, comprising:

an abutting layer that abuts against the toner image retainer, and a supporting layer that supports the abutting layer, wherein the maximum value D of a difference between a first loss tangent at 1 Hz and a second loss tangent at 100 Hz of the blade that includes the abutting layer and the supporting layer satisfies formula (1):

[Mathematical Formula 4]

$$0.2 \leq D \leq 0.7 \quad (1)$$

wherein the maximum value D is a maximum value of a difference between the first loss tangent and the second loss tangent at temperatures within a range of 0° C. to 50° C.

8. The blade according to claim 7, wherein the maximum value D further satisfies formula (2):

[Mathematical Formula 5]

$$0.35 \leq D \leq 0.55 \quad (2)$$

9. The blade according to claim 7, wherein the abutting layer has a thickness of 0.2 mm or more and 1.0 mm or less, and the supporting layer has a thickness of 0.8 mm or more and 2.0 mm or less.

10. The blade according to claim 7, wherein the maximum value D1 of a difference between a third loss tangent at 1 Hz and a fourth loss tangent at 100 Hz of the abutting layer satisfies formula (3), and the maximum value D2 of a difference between a fifth loss tangent at 1 Hz and a sixth loss tangent at 100 Hz of the supporting layer satisfies formula (4):

[Mathematical Formula 6]

$$0.45 \leq D1 \leq 0.90 \quad (3)$$

$$0.35 \leq D2 \leq 0.60 \quad (4)$$

wherein the maximum value D1 is a maximum value of a difference between the third loss tangent and the fourth loss tangent at temperatures within a range of 0° C. to 50° C., and the maximum value D2 is a maximum value of a difference between the fifth loss tangent and the sixth loss tangent at temperatures within a range of 0° C. to 50° C.

11. The blade according to claim 7, including two layers formed by the abutting layer and the supporting layer.

12. The blade according to claim 7, wherein the abutting layer and the supporting layer contain polyurethane.

13. An image forming apparatus comprising:

the toner image retainer, and the blade according to claim 7.

14. The image forming apparatus according to claim 13, wherein the toner image retainer is a photoreceptor, the image forming apparatus further comprising:

a charger that imparts a charge to the surface of the toner image retainer, an exposurer that performs exposure on the charged toner image retainer to produce an electrostatic latent image, a developer that forms a toner image from the electrostatic latent image and a toner, and a transferer that transfers the toner image to an image receiving material, wherein the toner image retainer has an outermost layer formed of a polymerized and cured product of a composition containing an inorganic filler, the surface of the outermost layer has raised structures constituted by protrusions of the inorganic filler, and an average height of the raised parts (nm) of the outermost layer denoted by $R_1$, an average distance between the raised parts (nm) of the raised structures constituted by protrusions of the inorganic filler on the outermost layer denoted by $R_2$, and an approximated spherical particle diameter (nm) of the toner denoted by $R_3$ satisfy the following formulae (5) to (7):

[Mathematical Formula 7]

$$R_2 \leq 2\sqrt{2R_1R_3 - R_1^2} \quad (5)$$

$$0 < R_1 < R_3 \quad (6)$$

$$0 < R_2 \leq 250 \quad (7)$$

15. An image forming method, comprising:

transferring a toner image from a toner image retainer to an image receiving material, and after the transferring, causing a blade to abut against the toner image retainer to clean the toner image retainer, wherein the blade includes:

an abutting layer that abuts against the toner image retainer, and a supporting layer that supports the abutting layer, wherein the maximum value D of a difference between a first loss tangent at 1 Hz and a second loss tangent at 100 Hz of the blade that includes the abutting layer and the supporting layer satisfies formula (1):

[Mathematical Formula 8]

$$0.2 \leq D \leq 0.7 \quad (1)$$

wherein the maximum value D is a maximum value of a difference between the first loss tangent and the second loss tangent at temperatures within a range of 0° C. to 50° C.

16. The image forming method according to claim 15, further comprising:

imparting a charge to the surface of the toner image retainer as a photoreceptor, performing exposure on the charged toner image retainer to produce an electrostatic latent image, and forming the toner image from the electrostatic latent image and a toner, wherein the toner image retainer has an outermost layer formed of a polymerized and cured product of a composition containing an inorganic filler, the surface of the outermost layer has raised structures constituted by protrusions of the inorganic filler, and an average height of the raised parts (nm) of the outermost layer denoted by $R_1$, an average distance between the raised parts (nm) of the raised structures constituted by protrusions of the inorganic filler on the outermost layer denoted by $R_2$, and an approximated spherical particle diameter (nm) of the toner denoted by $R_3$ satisfy the following formulae (5) to (7):

[Mathematical Formula 9]

$$R_2 \leq 2\sqrt{2R_1R_3 - R_1^2} \quad (5)$$

$$0 < R_1 < R_3 \quad (6)$$

$$0 < R_2 \leq 250 \quad (7).$$

* * * * *